US010015593B2

(12) United States Patent
Iyer et al.

(10) Patent No.: US 10,015,593 B2
(45) Date of Patent: Jul. 3, 2018

(54) DIGITAL SIGNAL PROCESSOR FOR AUDIO EXTENSIONS AND CORRECTION OF NONLINEAR DISTORTIONS IN LOUDSPEAKERS

(71) Applicant: The University of Utah, Salt Lake City, UT (US)

(72) Inventors: Ajay Iyer, Murray, UT (US); Jeffrey Hutchings, Sandy, UT (US); Richard Allen Kreifeldt, South Jordan, UT (US); V. John Mathews, Salt Lake City, UT (US); Shreyas Srikanth Payal, Salt Lake City, UT (US)

(73) Assignee: University of Utah, Salt Lake City, UT (US)

( * ) Notice: Subject to any disclaimer, the term of this patent is extended or adjusted under 35 U.S.C. 154(b) by 178 days.

(21) Appl. No.: 14/637,228

(22) Filed: Mar. 3, 2015

(65) Prior Publication Data

US 2015/0249889 A1 Sep. 3, 2015

(51) Int. Cl.
*H04R 29/00* (2006.01)
*H04R 3/08* (2006.01)

(52) U.S. Cl.
CPC ..... *H04R 3/08* (2013.01)

(58) Field of Classification Search
CPC ..... H04R 3/00; H04R 3/04; H04R 3/08
USPC ..... 381/59, 98
See application file for complete search history.

(56) References Cited

U.S. PATENT DOCUMENTS

2005/0271216 A1* 12/2005 Lashkari ..... H04R 3/04 381/59
2011/0309918 A1* 12/2011 Ramsay ..... G08B 29/24 340/407.1
2014/0119552 A1* 5/2014 Beaucoup ..... H04M 9/082 381/66
2015/0304772 A1* 10/2015 Risberg ..... H04R 3/007 381/55

OTHER PUBLICATIONS

L. L. Beranek and T. J. Mellow, Acoustics: Sound Fields and Transducers, chapter 6, Academic Press, Elsevier, Waltham, Massachusetts, USA, first edition, 2012.

(Continued)

*Primary Examiner* — Katherine Faley
(74) *Attorney, Agent, or Firm* — Artegis Law Group, LLP

(57) ABSTRACT

Digital filters for processing an input audio signal for extending the audio capabilities and reducing distortion of a loudspeaker. Such extension may include a general sound pressure level (SPL) extension or a more targeted low frequency (LF) extension. This may be accomplished by modifying an original frequency response of the loudspeaker to achieve a particular extension, and applying a digital linear filter based on the modified frequency response to the audio signal. A nonlinear digital filter may also be applied to the audio signal reduce nonlinear distortions of the loudspeaker. The nonlinear digital filter may be based on an inverse of an electro-mechanical model of the loudspeaker. In this manner, a loudspeaker may be driven close to its maximum theoretical power capability without increasing distortion in the loudspeaker output.

25 Claims, 16 Drawing Sheets

(56) References Cited

OTHER PUBLICATIONS

W. M. Leach Jr, "Loudspeaker voice-coil inductance losses: Circuit models, parameter estimation, and effect on frequency response," J. Audio Eng. Soc, vol. 50, No. 6, pp. 442-450, 2002.
W. Klippel, "Prediction of speaker performance at high amplitudes," in Audio Eng. Soc. Conv. 111, New York, NY, USA, Nov. 2001, No. 5418.
F. X. Y. Gao and W. M. Snelgrove, "Adaptive linearization of a loudspeaker," in Proc. IEEE International Conf. on Acoust., Speech and Signal Process., Toronto, Canada, Apr. 1991, vol. 5, pp. 3589-3592.
W. Klippel, "Direct feedback linearization of nonlinear loudspeaker systems," J. Audio Eng. Soc, vol. 46, No. 6, pp. 499-507, Jun. 1998.
J. Suykens, J. Vandewalle, and J. van Ginderdeuren, "Feedback linearization of nonlinear distortion in electrodynamic loudspeakers," J. Audio Eng. Soc, vol. 43, No. 9, pp. 690-694, Sep. 1995.
W. Klippel, "Distortion analyzer—a new tool for assessing and improving electrodynamic transducer," in Audio Eng. Soc. Conv. 108, Paris, France, Feb. 2000, No. 5109.
W. Klippel, "Klippel analyser research and development system," found at: http://www.klippel.de/our-products/rd-system.html, 2 pages.
Payal, "Equalization of Excursion and Current-Dependent Nonlinearities in Loudspeakers", 2014 IEEE International Conference on Acoustic, Speech and Signal Processing (ICASSP), 5 pages.

* cited by examiner

DIGITAL SIGNAL PROCESSOR FOR AUDIO EXTENSIONS AND CORRECTION OF NONLINEAR DISTORTIONS IN LOUDSPEAKERS

RELATED APPLICATIONS

This patent application claims the benefit of priority, under 35 U.S.C. § 119(e), of U.S. Provisional Application No. 61/947,268, filed Mar. 3, 2014, entitled "EQUALIZATION OF NONLINEAR DISTORTIONS IN LOUDSPEAKERS," which is expressly incorporated herein by reference.

FIELD OF THE INVENTION

The present disclosure relates to audio signal processing, and more specifically, to a digital signal processor for audio extensions and correction of nonlinear distortions in loudspeakers.

DESCRIPTION OF THE RELATED ART

A speaker (also referred to as a loudspeaker) is a transducer that produces a pressure wave in response to an input electrical signal, and thus, sound is generated. The loudspeaker input signal may be produced by an audio amplifier that receives a relatively lower voltage analog audio signal and generates an amplified signal to drive the loudspeaker. A dynamic loudspeaker is typically composed of a lightweight diaphragm (a cone) connected to a rigid basket (a frame) via a flexible suspension (often referred to as a spider) that constrains a voice coil to move axially through a cylindrical magnetic gap. When the input electrical signal is applied to the voice coil, a magnetic field is created by the electric current in the coil, thereby forming an electromagnet. By changing the electrical signal from the audio amplifier, the mechanical force generated by the interaction between the magnet and the voice coil is modulated and causes the cone to move back and forth, thereby creating the pressure waves interpreted as sound.

Direct-radiator loudspeakers are used in many applications such as tablet computers, mobile phones, laptop computers and desktop loudspeakers. They can be inexpensive and usually have a good linear response over a wide band of frequencies. However, they also introduce nonlinear distortions into the audio signals, especially when the input signals that drive the loudspeakers are extended or have large amplitudes.

Conventionally, extension of the audio signal has been performed using equalizers (EQs). In such cases, a digital audio signal may be equalized by an EQ, the equalized signal may be converted to an analog signal, and the analog signal may be amplified to drive a loudspeaker. However, such equalizers may not compensate for increased nonlinear distortion produced by the loudspeakers in response to equalization. The degree of increase in distortion and consequent impact on output audio quality is related to the amount of input power. For low levels of input power, the linear response of loudspeakers dominates, and the nonlinear distortion produced in the output audio may be within acceptable limits (e.g., based on audio quality). As the input power to the loudspeakers is increased, the nonlinearities inherent in the loudspeaker become dominant, increasing the distortion produced by the loudspeaker. Typically, the maximum input at which loudspeakers are operated (e.g., the maximum rated power of the loudspeaker) is close to the threshold of acceptable levels of distortion in the output audio. Because nonlinear distortion produced by the loudspeaker at the maximum rated power is at the threshold of acceptability, the maximum rated power at which a loudspeaker operates is typically much lower than a theoretical maximum power capability of the loudspeaker. This maximum theoretical sound pressure level (SPL) capability of a loudspeaker may be determined by the loudspeaker's maximum power handling and maximum excursion capability.

Conventional approaches do not take into account the increased nonlinear distortion produced by the loudspeaker due to the frequency-dependent increase in input power. The increase in distortion may significantly reduce the quality of the output audio and may result in an overall deterioration of the listening experience. Therefore, what would be useful are techniques for processing an audio signal such that a loudspeaker may operate close to its theoretical maximum power capability while limiting the nonlinear distortion of the loudspeaker.

SUMMARY

Certain aspects of the present disclosure provide a system and method for processing a digital audio signal by extending the frequency response of a loudspeaker and reducing or removing the nonlinear distortion of the loudspeaker. The audio signal may be extended by applying a digital linear filter based on a modified frequency response of the loudspeaker. The nonlinear distortion of the loudspeaker may be canceled out or reduced using a digital nonlinear filter based on an inverse of a parametric model of the loudspeaker.

The digital linear filter may be based on a modified frequency response of the loudspeaker, the modified frequency response being generated by modifying at least a portion, or all, of an original frequency response of the loudspeaker. The modified frequency response of the loudspeaker may provide sound pressure level (SPL) extension and/or low frequency (LF) extension relative to the original frequency response of the loudspeaker. In certain aspects, the LF response may be extended to provide higher SPL output at low audio frequencies. This is of particular interest for subwoofers and other loudspeakers where a higher bass response may be desired. The digital linear filter may be generated based on the desired modified frequency response.

The digital nonlinear filter may be based on an inverse of a parametric model of the loudspeaker, the parametric model based on multiple parameters of the loudspeaker. The loudspeaker comprises a plurality of electrical and mechanical components that each contributes nonlinear distortion to audio sound produced by the loudspeaker. In some embodiments, the parametric model comprises an electro-mechanical model of the loudspeaker, the electro-mechanical model being based on a plurality of parameters of the electrical and/or mechanical components composing the loudspeaker. The electro-mechanical model represents/captures nonlinear distortions contributed by the various parameters of the electrical and/or mechanical components. In some embodiments, parameters included in the electro-mechanical model that contribute nonlinear distortions comprise excursion dependent nonlinearities, current-dependent nonlinearities, and/or nonlinear distortions due to eddy currents on the loudspeaker output. In some embodiments, the parameters comprise nonlinearities that depend on the displacement of the voice coil and/or the current in the voice coil of the loudspeaker. The parameters may comprise nonlinear distortions of the loudspeaker that depend on its geometric construction and materials used in a voice coil, a diaphragm, and an enclosure of the loudspeaker. As further examples, the multiple parameters that contribute nonlinear distortions may include a stiffness of the loudspeaker diaphragm, suspension stiffness of the diaphragm, a force factor, para-inductance, para-resistance, an inductance of a voice coil, a resistance in the voice coil, eddy currents, a mechanical load resistance of the loudspeaker, or any combination thereof. In other embodiments, other parameters of the electrical or mechanical components of the loudspeaker may be used in the electro-mechanical model. In certain aspects, the digital nonlinear filter is generated based on an inverse of the parametric model and configured to reduce nonlinear distortion contributed by at least one of the multiple parameters. In this way, the digital nonlinear filter may cancel or reduce loudspeaker distortions caused by nonlinearities of at least one of the parameters of the electro-mechanical model. Applying the digital nonlinear filter to the input audio signal can cancel out or reduce these nonlinear distortions and reproduce higher fidelity audio.

The digital linear filter (providing audio extension) and digital nonlinear filter (providing reduction of nonlinear distortion) can be applied to the digital audio signal separately and independently, or in combination. When used in combination, the digital linear filter is applied to a digital audio signal to generate a first filtered signal, wherein the digital linear filter is based on a first frequency response created by modifying at least a portion of a second frequency response (original frequency response) representative of a loudspeaker; and applying a digital nonlinear filter to the first filtered signal to generate a second filtered signal, wherein the digital nonlinear filter is based on an inverse of an electro-mechanical model of the loudspeaker. In certain aspects, the digital linear filter is configured to filter the audio signal, and the digital nonlinear filter is configured to filter the filtered audio signal from the digital linear filter. For other aspects, the digital nonlinear filter may be configured to filter the audio signal, and the digital linear filter may be configured to filter the filtered audio signal from the digital nonlinear filter.

Certain aspects of the present disclosure provide an apparatus for processing a digital audio signal. The apparatus generally includes means for applying a digital linear filter to the digital audio signal to generate a first filtered signal. The digital linear filter is based on a modified frequency response created by modifying at least a portion of an original frequency response representative of a loudspeaker. The apparatus further includes means for applying a digital nonlinear filter to the first filtered signal to generate a second filtered signal, wherein the digital nonlinear filter is based on an inverse of a parametric model of the loudspeaker. In certain aspects, the apparatus may further comprise means for converting the second filtered signal to an analog signal and means for amplifying the analog signal to drive the loudspeaker.

Certain aspects of the present disclosure provide an apparatus for creating filters to process an audio signal. The apparatus generally includes means for modifying at least a portion of an original frequency response representative of a loudspeaker, means for generating a digital linear filter based on the modified frequency response, means for generating a parametric model of the loudspeaker, and means for generating a digital nonlinear filter based on an inverse of the parametric model of the loudspeaker.

Certain aspects of the present disclosure provide a method for creating filters to process an audio signal. The method generally includes modifying at least a portion of an original frequency response representative of a loudspeaker and generating a digital linear filter based on the modified frequency response. The method may also include generating a parametric model of the loudspeaker and generating a digital nonlinear filter based on an inverse of the parametric model of the loudspeaker.

Certain aspects of the present disclosure provide a computer program product for creating filters to process an audio signal. The computer program product generally includes a non-transitory computer-readable storage medium having computer-readable program code embodied therewith, the computer-readable program code executable by one or more computer processors to modify at least a portion of an original frequency response representative of a loudspeaker, generate a digital linear filter based on the modified frequency response, generate a parametric model of the loudspeaker, and generate a digital nonlinear filter based on an inverse of the parametric model of the loudspeaker.

DETAILED DESCRIPTION

Certain aspects of the present disclosure provide a system and method for processing a digital audio signal by extending the extending the frequency response and/or increasing the sound pressure level (SPL) output of a loudspeaker and reducing the nonlinear distortion in the loudspeaker's acoustical output. For example, SPL and/or LF extension may be applied to an audio signal, followed by a nonlinear correction for a particular loudspeaker model.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the following, reference is made to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the following aspects, features, embodiments and advantages are merely illustrative and are not considered elements or limitations of the appended claims except where explicitly recited in a claim(s). Likewise, reference to "the disclosure" shall not be construed as a generalization of any inventive subject matter disclosed herein and shall not be considered to be an element or limitation of the appended claims except where explicitly recited in a claim(s).

Audio System Overview

Certain aspects of the present disclosure provide an audio system. The audio system generally includes a digital signal processor (DSP) configured to apply a digital linear filter and/or a digital nonlinear filter to a digital audio signal. According to certain aspects, the audio system further includes a digital-to-analog converter (DAC) configured to convert a digital output of the DSP to an analog signal and an amplifier configured to amplify the analog signal for driving the loudspeaker. For example, the audio system may comprise an audio receiver with loudspeaker or a soundbar.

Figure 1:
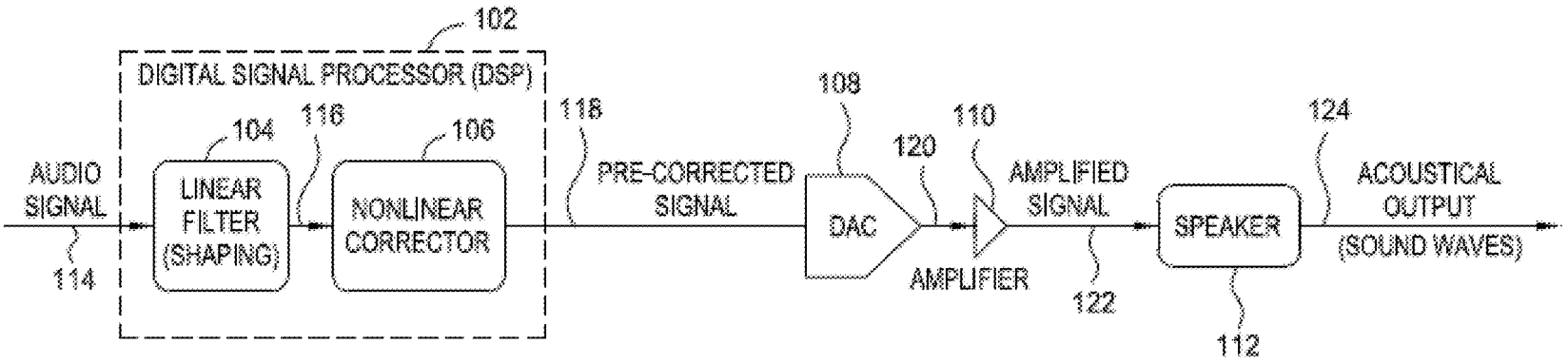
FIG. 1 is a signal flow diagram for frequency response extension with nonlinear correction, in accordance with certain aspects of the present disclosure.

FIG. 1 illustrates a signal flow diagram for audio extension and nonlinear correction, in accordance with certain aspects of the present disclosure. As illustrated, a digital signal processor (DSP) 102 may receive and process an audio signal (e.g., a digital audio signal) 114, for example, by applying one or more digital filters 104 and 106 aimed at increasing audio quality. The filtered digital signal (pre-corrected signal 118) produced by the DSP 102 may be converted to an analog signal 120 using a digital-to-analog converter (DAC) 108. The analog signal 120 may be amplified using amplifier 110 to generate an amplified signal 122. The amplified signal 122 may drive a loudspeaker 112 to produce an acoustic output 124 (e.g., sound waves). The loudspeaker 112 may comprise a dynamic loudspeaker, a direct-radiator loudspeaker, or the like, enclosed in a closed cabinet.

As used herein, a DSP 102 may sometimes be referred to as an equalizer. As used herein, producing the pre-corrected signal 118 may also be referred to as pre-inversing or pre-distorting the audio signal since the pre-distortions in combination with the distortions of the loudspeaker will produce output audio with no distortions ideally and substantially reduced distortions in practice. Depending upon the embodiment, the pre-corrected signal 118 being converted and the analog signal 120 being amplified may be the respective, native signals themselves (e.g., the signal directly output by the DSP in the case of the pre-corrected signal 118), or a further processed version thereof (e.g., having further filtering and/or other signal processing applied). Unless apparent from context or explicitly stated otherwise, reference to these signals contemplates either embodiment.

The DSP 102 may be used to apply one or more filters aimed at improving the sound quality of the acoustic output 124. For example, the filters applied by the DSP may include a digital linear filter 104 (e.g., a modified shaping filter 104) and a digital nonlinear filter 106 (e.g., a nonlinear correction filter 106), according to certain aspects of the present disclosure. That is, the DSP 102 may apply the modified shaping filter 104 to the audio signal 114 to generate a first filtered signal 116. As used herein, a "shaping filter" generally refers to a digital linear filter whose response matches the linear frequency response of a loudspeaker without correction. The DSP 102 may further apply the nonlinear correction filter 106 to the first filtered signal 116, or a further processed version thereof, to generate a second filtered signal 118 (pre-corrected signal 118). The DSP 102 may comprise computer hardware (such as a processor) that executes software stored on a computer-readable medium to perform the operations of the DSP 102 described herein.

As a result, an output frequency response of an audio system (e.g., a soundbar or an audio receiver plus a loudspeaker) with audio extension implemented according to aspects of the present disclosure may have no more harmonic distortion than the system frequency response without correction, as discussed in more detail below. In certain aspects, the nonlinear correction filter 106 may be applied prior to the modified shaping filter 104.

The amount of audio extension that may be applied by the DSP 102 may be limited by the maximum power handling capability and/or maximum excursion capability of the loudspeaker 112, which may be different for different types of loudspeakers. Distortions caused by certain loudspeaker designs may also be easier to correct for than others.

Therefore, the amount of SPL and/or LF extension possible may be largely dependent on the loudspeaker design.

Digital Linear Filter for Audio Extension

Figure 2:
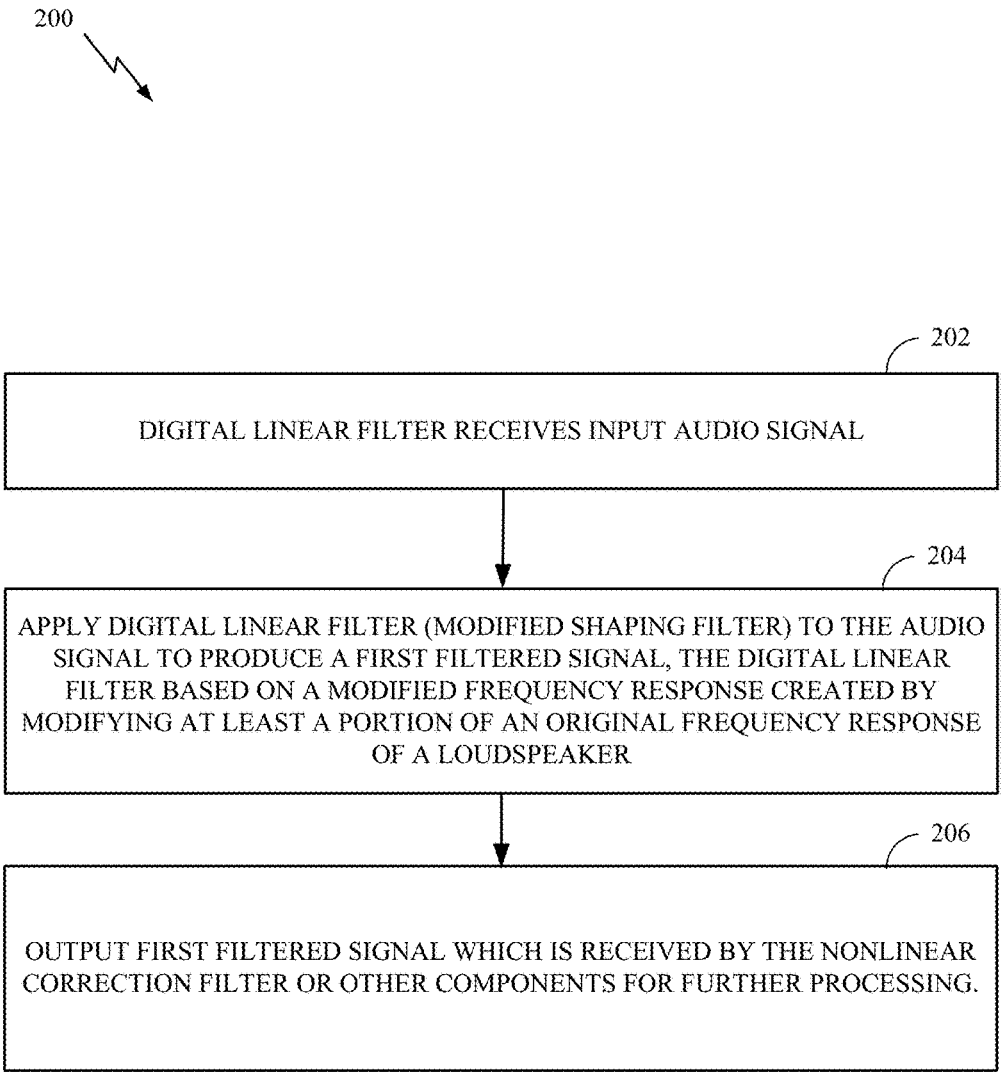
FIG. 2 is a flow diagram of operations for processing an audio signal via the digital linear filter of FIG. 1, in accordance with certain aspects of the present disclosure.

FIG. 2 is a flow diagram of operations 200 for processing an audio signal via the digital linear filter 104 of FIG. 1, in accordance with certain aspects of the present disclosure. At least some of the operations 200 may be performed, for example, by a processor, such as the DSP 102 of FIG. 1. The DSP 102 may comprise computer hardware (such as a processor) that executes software stored on a computer-readable medium to perform the operations 200.

The operations 200 may begin, at 202, when the digital linear filter 104 receives an input audio signal (e.g., digital audio signal 114). The DSP 102 applies, at 204, a digital linear filter 104 (e.g., modified shaping filter 104) to the digital audio signal 114 to produce a first filtered signal (e.g., signal 116). The digital linear filter is based on a modified frequency response created by modifying at least a portion of an original frequency response representative of a loudspeaker (e.g., loudspeaker 112). At 206, the first filtered signal 116 is output, which may be received for further processing by the nonlinear correction filter 106 of the DSP 102. In other embodiments, the first filtered signal 116 is not further processed by the nonlinear correction filter 106 and is received by a DAC 108 for further processing.

Modified Frequency Response

The digital linear filter 104 (e.g., a modified shaping filter 104) may be based on a modified frequency response of the loudspeaker, the modified frequency response being generated by modifying at least a portion, or all, of an original frequency response of the loudspeaker. According to certain aspects, to produce the modified frequency response, the original frequency response is modified by at least one of: (1) extending a low frequency response to provide an increased sound pressure level (SPL) at low audio frequencies; and (2) extending all frequencies in a particular selected bandwidth (e.g., from 20 Hz to 1 kHz) of the original frequency response to provide an increased SPL in the selected bandwidth. The selected bandwidth may comprise a sub-set of the overall bandwidth that the loudspeaker is capable of reproducing. This selected bandwidth may include low and high audio frequencies, for example. The bandwidth may include frequencies above and/or below a resonant frequency of the original frequency response. For certain aspects, the bandwidth may include low and high audio frequencies. In certain aspects, extending the low frequency response changes a resonant frequency of the original frequency response, while in other aspects, extending the low frequency response does not change the resonant frequency or moves the resonant frequency of the loudspeaker. In certain aspects, extending all frequencies in the selected bandwidth entails uniformly extending all frequencies in the bandwidth of the original frequency response, whereas in other aspects, different frequencies in the selected bandwidth may be extended differently. The digital linear filter may be generated based on the desired modified frequency response.

For example, the original frequency response may comprise the linear response of the loudspeaker without adjustments or correction. The original frequency response may be referred to herein as a natural frequency response of the loudspeaker. The original frequency response may be modified by applying gain either across all frequencies, or to specific frequency bands, as desired. That is, gain may be applied across a low-frequency band for LF extensions (e.g., to increase bass for a subwoofer). In certain aspects, gain may be applied to all frequencies (within an audio bandwidth) to increase the SPL of the audio signal. Based on the LF and/or SPL extended frequency response, the digital linear filter may be created using, for example, finite impulse response (FIR) or infinite impulse response (IIR). That is, a processor may generate a transfer function (e.g., an FIR- or IIR-type transfer function) based on a desired frequency response using a mathematical procedure. For example, a transfer function based on FIR subjects an input signal to a number of delay stages, wherein the output signal is generated based on a weighted sum of the delayed signals. The desired frequency response may be obtained by shaping the original frequency response of a loudspeaker, as desired. Therefore, the digital linear filter generated by this procedure may be referred to as a modified shaping filter 104. The transfer function may be implemented in a DSP 102 using software and applied to an audio signal input to be processed by the DSP. Example LF and/or SPL extended frequency responses are illustrated and described in more detail below, with respect to FIGS. 3-6.

Figure 3:
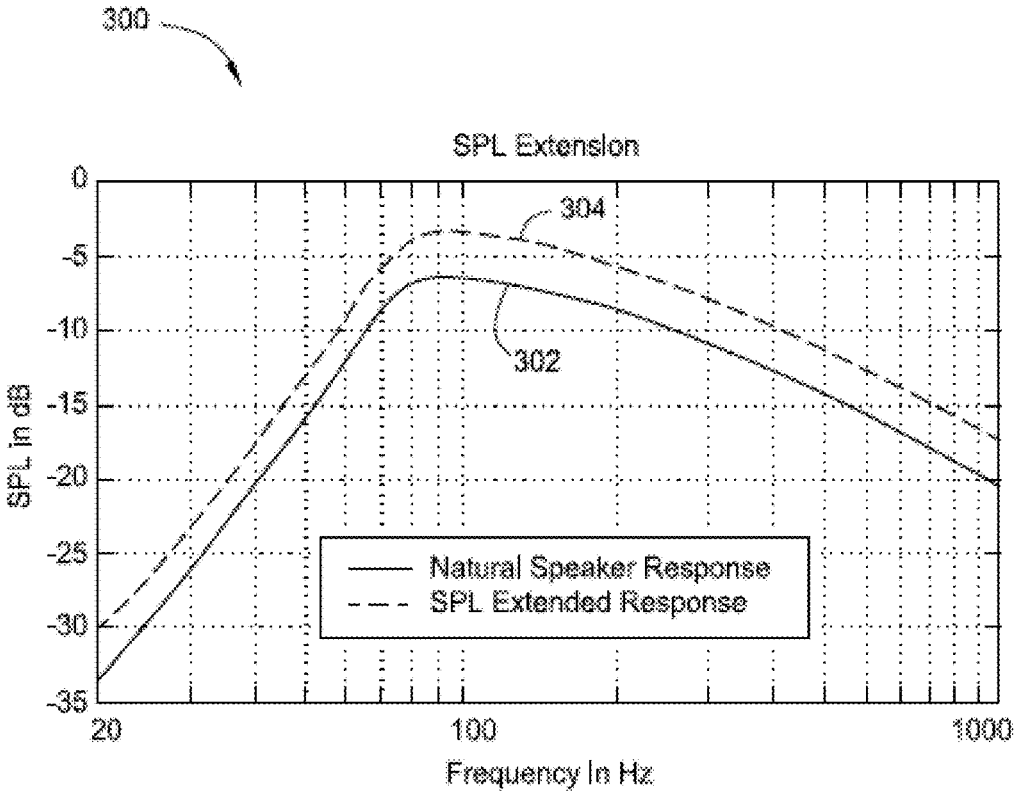
FIG. 3 is a graph illustrating an sound pressure level (SPL) extended frequency response as compared to an original frequency response of a loudspeaker, in accordance with certain aspects of the present disclosure.

FIG. 3 is a graph 300 illustrating an sound pressure level (SPL) extended frequency response 304 as compared to an original frequency response of a loudspeaker, in accordance with certain aspects of the present disclosure. The frequency response 302 represents the original frequency response of the loudspeaker 112, as described above. As illustrated in FIG. 3, gain is applied across all frequencies of the frequency response 302 to increase SPL and generate the first filtered signal having the frequency response 304. The gain may be applied uniformly, as illustrated.

Figure 4:
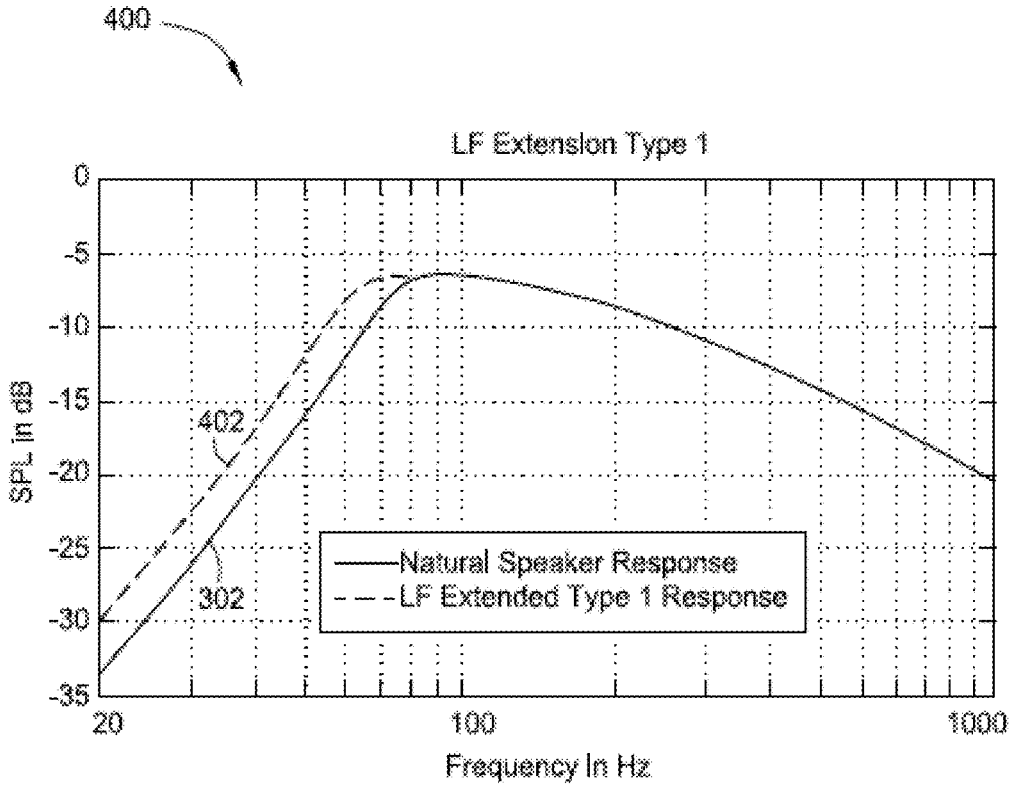
FIG. 4 is a graph illustrating a first type of example low frequency (LF) extended frequency response as compared to the natural frequency response of a loudspeaker, in accordance with certain aspects of the present disclosure.

FIG. 4 is a graph 400 illustrating a desired frequency response 402 of a first type of example LF extension in dB, in accordance with certain aspects of the present disclosure. As illustrated, the first type of LF extension applies a uniform shift (i.e., a frequency-independent shift) across a low-frequency band of the frequency response 302 to obtain the frequency response 402. This type of LF extension may result in a change in the resonant frequency of the loudspeaker's original frequency response (e.g., a shift to a lower frequency). That is, as illustrated, the resonant frequency of the frequency response 302 may be different (e.g., higher) than the resonant frequency of the frequency response 402 (first type of LF extension).

Figure 5:
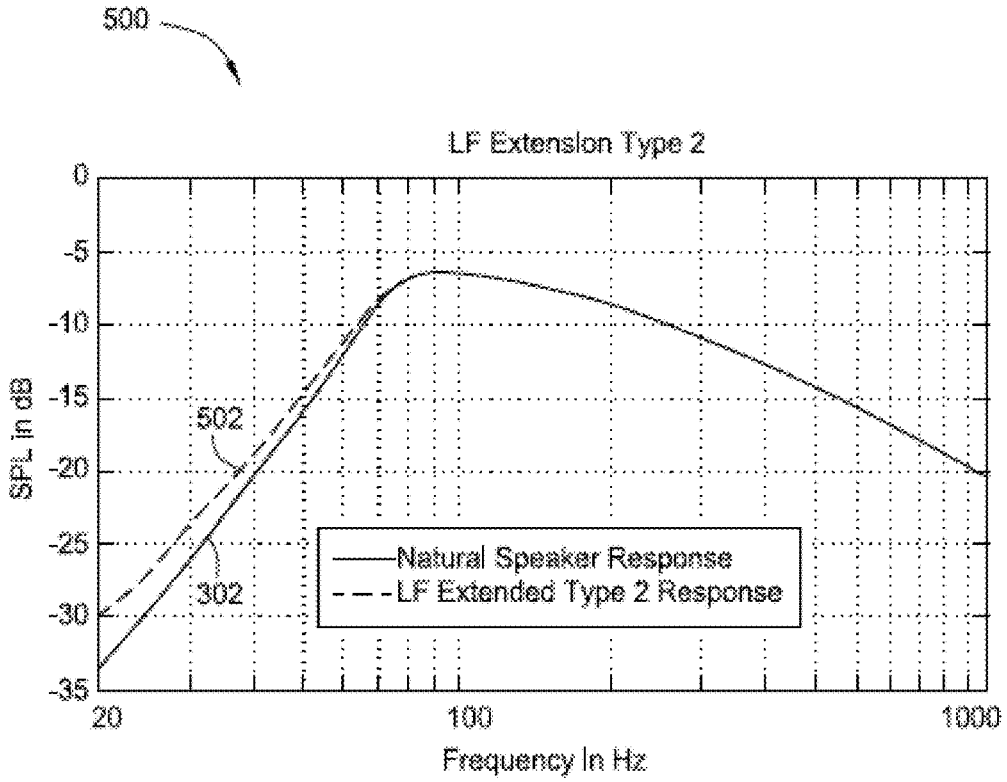
FIG. 5 is a graph illustrating a second type of example LF extended frequency response as compared to the natural frequency response of a loudspeaker, in accordance with certain aspects of the present disclosure.

FIG. 5 is a graph 500 illustrating a desired frequency response 502 of a second type of example LF extension in dB, in accordance with certain aspects of the present disclosure. As illustrated, the second type of LF extension may apply a frequency-dependent gain across a low frequency band of the frequency response 302 to obtain the frequency response 502. For example, more gain may be applied to the lowest frequencies, whereas less gain may be applied to higher frequencies in the low frequency band. The frequency-dependent gain function may be linear as shown in FIG. 5, but may be nonlinear for other aspects. This type of extension may not impact the resonant frequency of the loudspeaker's frequency response. That is, the resonant frequency of the frequency response 302 may be the same as the resonant frequency of the frequency response 502 (second type of LF extension).

Figure 6:
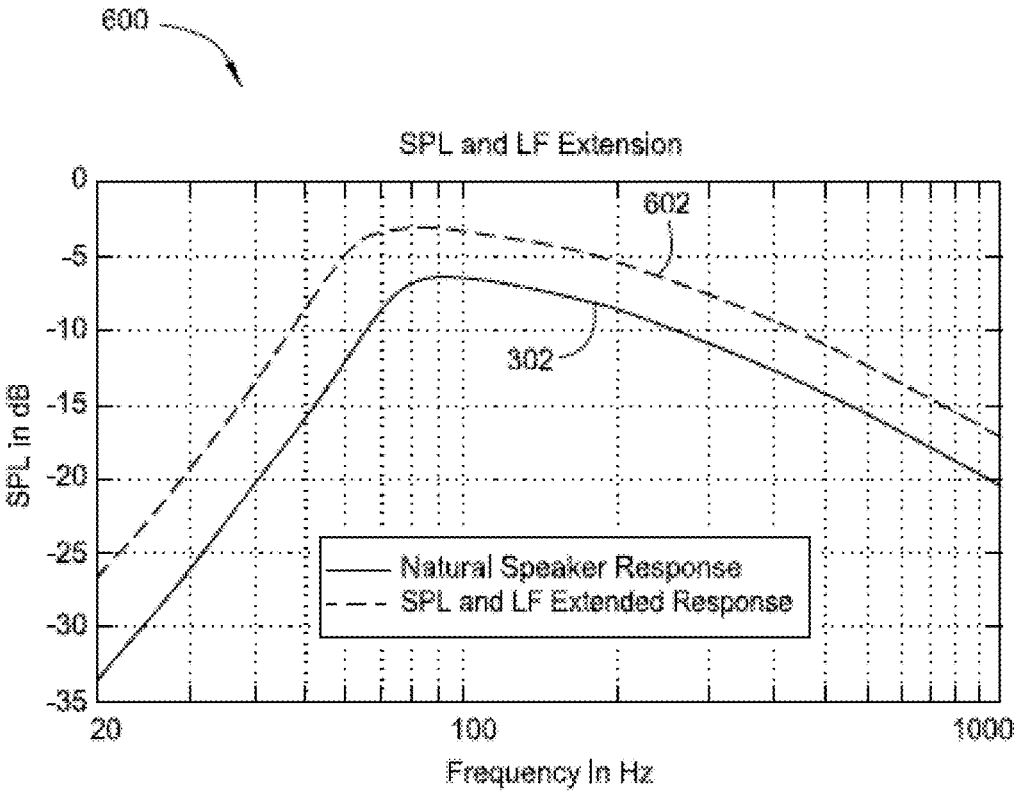
FIG. 6 is a graph illustrating an combined LF and SPL extended frequency response as compared to the natural frequency response of a loudspeaker, in accordance with certain aspects of the present disclosure.

Certain aspects of the present disclosure may apply both SPL and LF extension. FIG. 6 is a graph 600 illustrating a desired frequency response 602 with an SPL and LF extension in dB, in accordance with certain aspects of the present disclosure. As illustrated, the frequency response 302 may be shifted uniformly across all frequencies to achieve SPL extension and further shifted across a low frequency bandwidth of the frequency response 302 (e.g., as in FIG. 4) to obtain the frequency response 602. For other aspects, the LF extension applied may be the second type of LF extension described with respect to FIG. 5 or another type of LF extension.

Technique for Producing a Digital Linear Filter for Audio Extension

Figure 7:
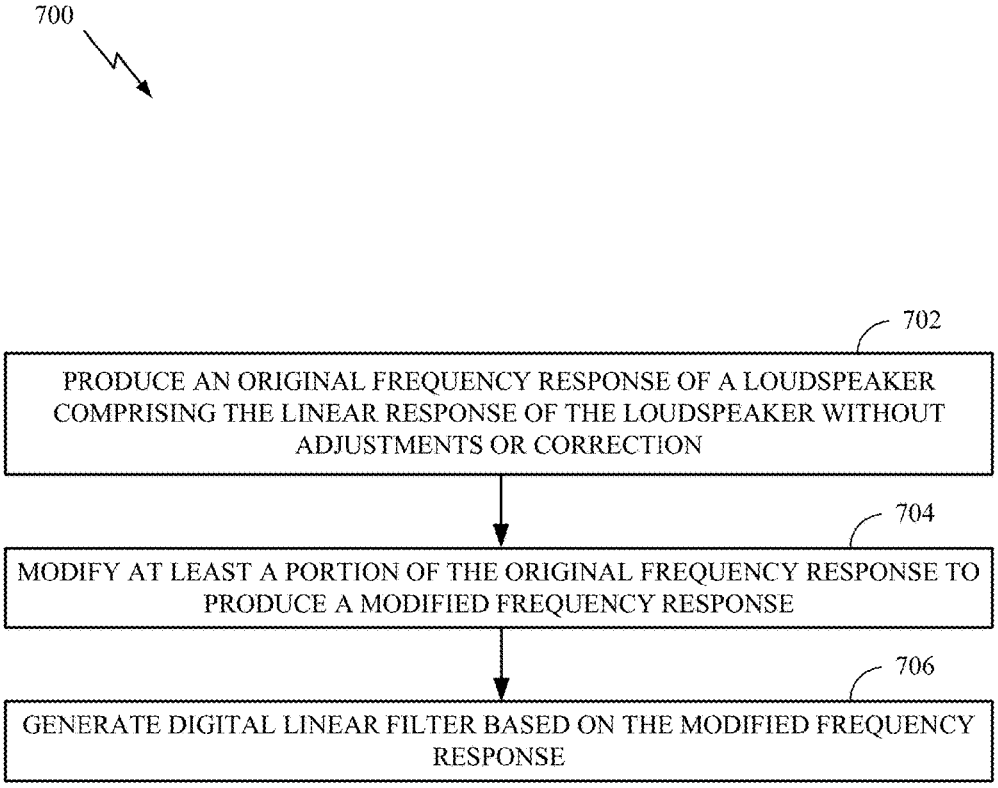
FIG. 7 is a flow diagram of operations for creating a digital linear filter to process an audio signal, in accordance with aspects of the present disclosure.

FIG. 7 is a flow diagram of operations 700 for creating a digital linear filter to process an audio signal, in accordance with aspects of the present disclosure. The operations 700 may be performed, for example, by at least one processor (e.g., a computer processing system).

The operations 700 begin, at 702, by producing an original frequency response of a loudspeaker 112, the original frequency response comprising the linear response of the loudspeaker 112 without adjustments or correction and representing the natural frequency response of the loudspeaker 112. The processor then modifies, at 704, at least a portion of the original frequency response of the loudspeaker to produce a modified frequency response (e.g., frequency responses 304, 402, 502, 602 of FIGS. 3-6, respectively). For example, the processor may modify the original frequency response (e.g., frequency response 302 of FIGS. 3-6) based on at least one of SPL or LF extension examples as described with reference to FIGS. 3-6. At 706, the processor may generate a digital linear filter 104 based on the modified frequency response.

According to certain aspects, the modifying at 704 may involve at least one of: (i) extending a low frequency response to provide an increased sound pressure level (SPL) at low frequencies; and (ii) extending all frequencies in a bandwidth of the frequency response representative of the loudspeaker to provide an increased SPL. For example, the bandwidth may include frequencies above and below a resonant frequency of the original frequency response representative of the loudspeaker. In certain aspects, extending the low frequency response changes a resonant frequency of the original frequency response representative of the loudspeaker.

Digital Nonlinear Filter for Distortion Correction

Figure 8:
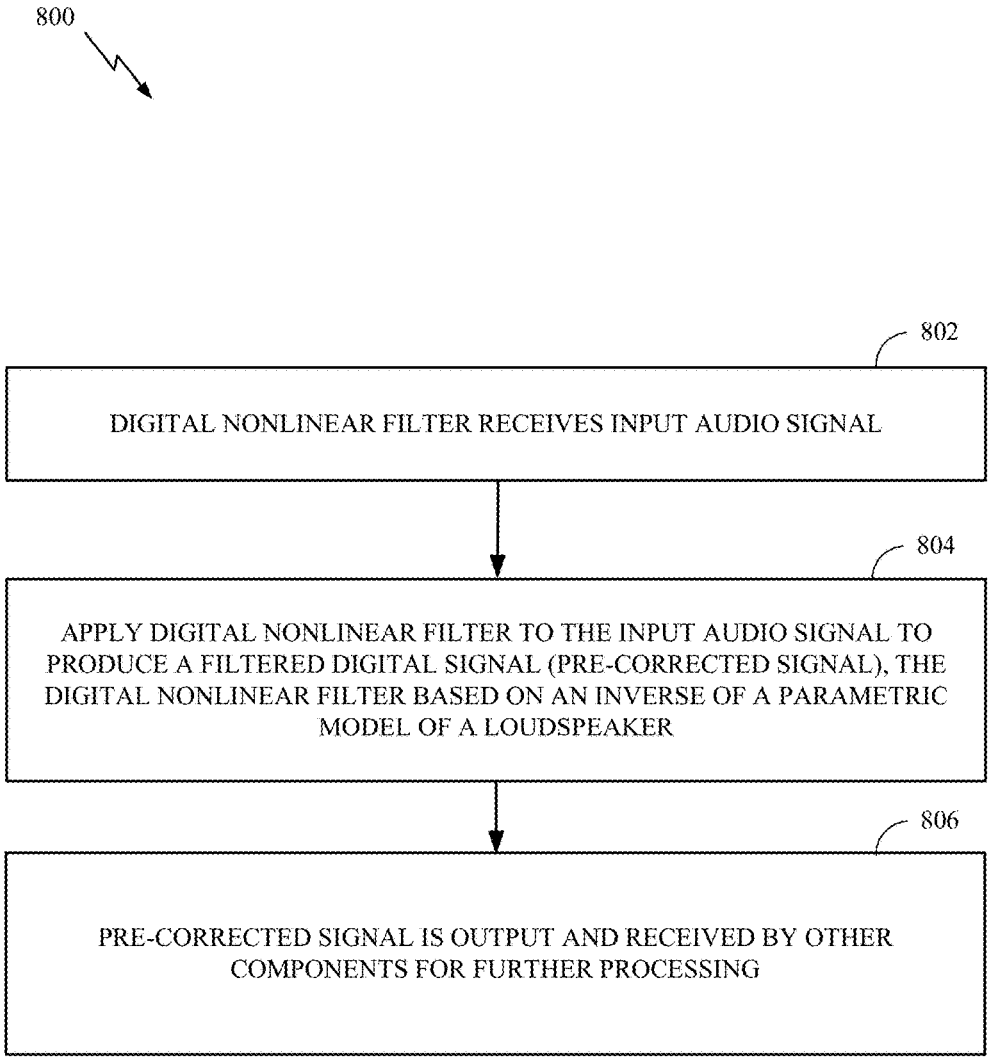
FIG. 8 is a flow diagram of operations for processing a digital audio signal via the digital nonlinear filter of FIG. 1, in accordance with certain aspects of the present disclosure.

Processing of an input audio signal by applying a digital nonlinear filter (e.g., nonlinear correction filter 106) can cancel out or reduce nonlinear effects caused by the loudspeaker 112. FIG. 8 is a flow diagram of operations 800 for processing a digital audio signal via the digital nonlinear filter 106 of FIG. 1, in accordance with certain aspects of the present disclosure. At least some of the operations 800 may be performed, for example, by a processor, such as the DSP 102 comprising the digital nonlinear filter 106. The DSP 102 may comprise computer hardware (such as a processor) that executes software stored on a computer-readable medium to perform the operations 800.

The operations 800 may begin, at 802, when the digital nonlinear filter 106 (e.g., a nonlinear correction filter 106) receives an input audio signal. The input audio signal may comprise digital audio signal 114 or the first filtered signal 116 received from the digital linear filter 104. The DSP 102 applies, at 804, the digital nonlinear filter 104 to the input audio signal to produce a filtered digital signal (pre-corrected signal 118). At 806, the pre-corrected signal 118 is output, which is received by other components for further processing (e.g., received by the DAC to convert the pre-corrected signal 118 to an analog signal which is amplified by an amplifier to drive the loudspeaker).

Parametric Model of a Loudspeaker

The digital nonlinear filter 106 may be generated based on an inverse of a parametric model of the loudspeaker, the parametric model being based on a plurality of parameters of the loudspeaker. The loudspeaker comprises a plurality of electrical and mechanical components that each contributes nonlinear distortion to audio sound produced by the loudspeaker. In some embodiments, the parametric model comprises an electro-mechanical model of the loudspeaker, the electro-mechanical model being based on a plurality of parameters of the electrical and/or mechanical components composing the loudspeaker. The electro-mechanical model represents/captures nonlinear distortions contributed by the various parameters of the electrical and/or mechanical components. In some embodiments, parameters included in the electro-mechanical model that contribute nonlinear distortions comprise excursion dependent nonlinearities, current-dependent nonlinearities, and/or nonlinear distortions due to eddy currents on the loudspeaker output. In some embodiments, the parameters comprise nonlinearities that depend on the displacement of the voice coil and/or the current in the voice coil of the loudspeaker. For example, the multiple parameters that contribute nonlinear distortions may include a stiffness of the loudspeaker diaphragm, suspension stiffness of the diaphragm, a force factor, para-inductance, para-resistance, an inductance of a voice coil, a resistance in the voice coil, eddy currents, a mechanical load resistance of the loudspeaker, or any combination thereof. In other embodiments, other parameters of the electrical or mechanical components of the loudspeaker may be used in the electro-mechanical model.

The DSP 102 may apply a filter function based on the inverse of the electro-mechanical model, where an exact inverse is obtained by inverting all operations in the loudspeaker model (electro-mechanical model). For example, if the model includes applying various operations according to a matrix H to a loudspeaker input voltage u(t) to generate a loudspeaker output pressure signal p(t), then the inverse of the model may be written as $p(t)=H^{-1}u(t)$. Applying a filter based on the inverse of the model can cancel out or compensate for the nonlinearity and distortion effects caused by the loudspeaker and accounted for in the model based on the parameters. More accurate loudspeaker models are better equipped to compensate for the distortions introduced by excursion and current-dependent nonlinearities.

Any of various suitable parameters may be used for quantifying characteristics of the loudspeaker 112 and taken into account by the model. For example, the parameters may include suspension stiffness, force factor nonlinearity, an inductance of a voice coil in the loudspeaker 112, a resistance in the voice coil, eddy currents, and a mechanical load resistance associated with the loudspeaker 112. The suspension stiffness arises from the material properties in the surround and the spider of the loudspeaker 112. The force factor nonlinearity describes the frequency-independent electromechanical coupling in the loudspeaker, which may be modeled as a gyrator. The inductance of the voice coil may be a function of its displacement and the current in the voice coil of the loudspeaker. To model eddy currents in the pole pieces and the plates of the loudspeaker, a parallel combination of an inductance and a resistance may be included in the model. These inductances also induce a reluctance force in the moving components of the loudspeaker 112. The electrical voice coil windings may have a resistance. The electrical components may be modeled via one or more equations according to Kirchhoff's voltage law (KVL). A force equation may be written for the mechanical components to include the mechanical load resistance (like friction) that affects the diaphragm and the moving mass of the diaphragm of the loudspeaker. In certain aspects, the electro-mechanical model of the loudspeaker further comprises an electrical model of the amplifier (e.g., amplifier 110) configured to drive the loudspeaker.

Some embodiments present a DSP 102 comprising a digital nonlinear filter 106 for direct-radiator loudspeakers that compensates for distortions introduced into audio signals by nonlinear effects of the loudspeaker. These nonlinear effects of the loudspeaker depend on its geometric construction and the materials used in the voice coil, the diaphragm and the enclosure. The digital nonlinear filter 106 may be generated by constructing an electro-mechanical model of the loudspeaker and then constructing an exact inverse of an electro-mechanical model of the loudspeaker, the digital nonlinear filter 106 being based on the inverse of the electro-mechanical model. This exact inverse compensates for distortions introduced by excursion and current-dependent nonlinearities and those due to eddy currents on the loudspeaker output. For example, the digital nonlinear filter 106 may compensate for the nonlinearities in the force factor, voice coil inductance, para-inductance, para-resistance, suspension system, and/or the stiffness of the loudspeaker diaphragm and reduce distortions due to eddy currents in the loudspeaker system. Substantial reduction in the harmonic distortions at the output of the loudspeaker has been demonstrated via simulation results. The DSP 102 comprising a digital nonlinear filter 106 may be referred to in this section as an equalizer.

Technology described herein deals with compensation of nonlinear distortions in direct radiating loudspeakers. There are many sources of nonlinearities in loudspeakers; and the distortions due to these nonlinearities increase with the strength of the input signal that drives the loudspeakers. The technology herein provides an equalizer (comprising a digital nonlinear filter 106) for correcting loudspeaker distortions caused by nonlinearities in the force factor, voice coil inductance, para-inductance, para-resistance and stiffness of the loudspeaker diaphragm, suspension system, as well as eddy currents in the loudspeaker system. These nonlinearities may depend on the displacement of the voice coil and/or the current in the voice coil of the loudspeaker.

In another configuration, the invention involves an exact inverse of a nonlinear model of the loudspeaker. As long as the parameters can be measured with reasonable accuracy, the method will perform well. A very large class of nonlinearities that exists in loudspeakers can be compensated for by the method of this invention. Specifically, the method can equalize for excursion and current-dependent nonlinearities, and also mitigate the distortions due to eddy currents.

In another example, the method can be used to create a preprocessor for audio signals before they are input to the loudspeaker. The system "pre-distorts" the input signal so that the pre-distortions in combination with the distortions of the loudspeaker will produce output audio with no distortions ideally and substantially reduced distortions in practice.

Technology for equalization of nonlinear distortions in a loudspeaker is disclosed. One method can include modeling parameters of the loudspeaker. An equalizer can process an input signal for the loudspeaker with an inverse system of the modeled loudspeaker including contributions of at least one of excursion dependent and current dependent nonlinearities. In some cases the contributions can include excursion dependent and current dependent nonlinearities. More specifically, the contributions can include one or more of nonlinear effects in a force factor, a voice coil inductance, para-inductance, para-resistance, stiffness of a loudspeaker diaphragm, a suspension system, and eddy currents, although other factors can also be considered.

According to certain aspects, the DSP 102 or another processor may modify parameters of the parametric model of the loudspeaker based on known or measured changes in the loudspeaker parameters due to aging, for example, update the inverse of the parametric model accordingly, and generate an updated digital nonlinear filter based on the updated inverse of the parametric model. For example, various sensors may be used to measure changes in the characteristics of the loudspeaker 112 and adjust the parameters of the electro-mechanical model accordingly. In certain aspects, the DSP 102 or another processor may be configured to change the parameters based on a predetermined function for the loudspeaker characteristics. For example, the parameters of the parametric model of the loudspeaker may be adjusted as a function of time, a number of operating hours for the loudspeaker, a total amount of power transferred to the loudspeaker, and the like, which may be tracked by the DSP 102 or another processor.

Figure 9:
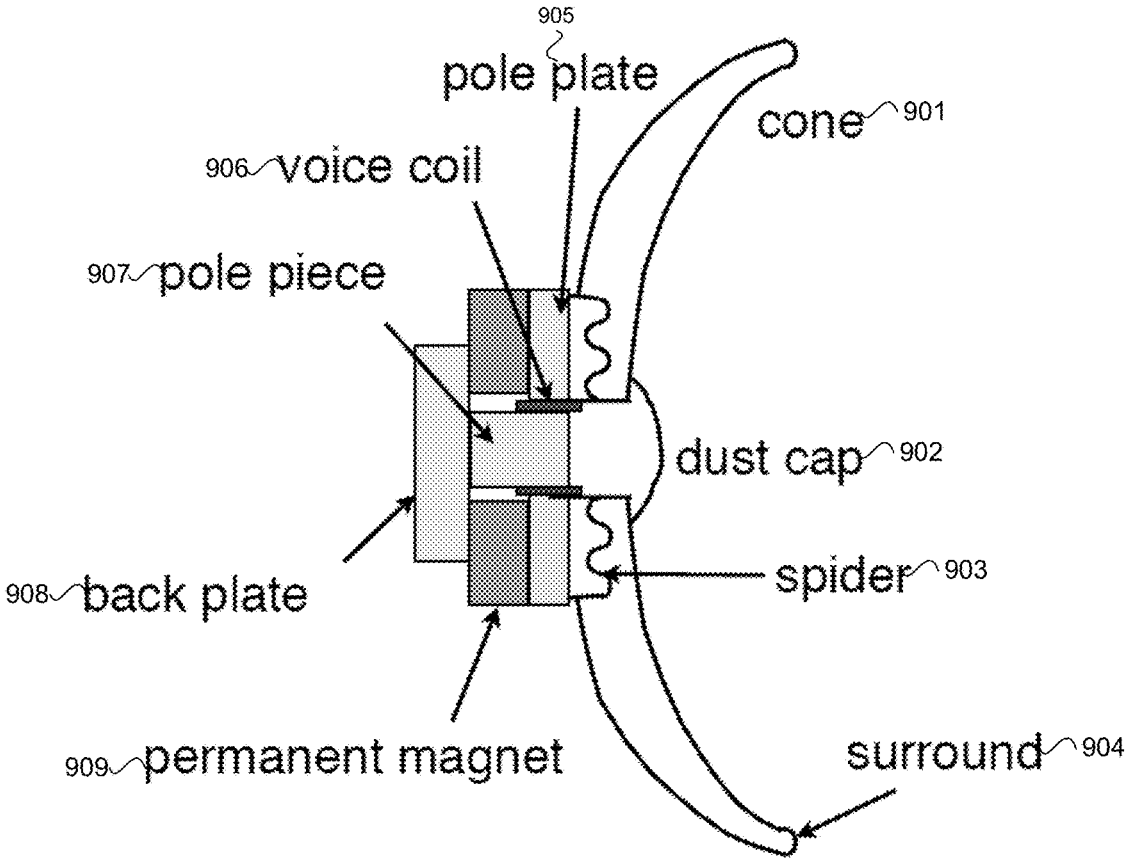
FIG. 9 is an example illustration of a diagrammatic representation of components of a direct-radiator loudspeaker.

The electro-mechanical model of the loudspeaker 112 may be based on various parameters of the electrical and/or mechanical components composing the loudspeaker 112. FIG. 9 is an example illustration of a diagrammatic representation of components of a direct-radiator loudspeaker. FIG. 9 displays a schematic diagram of the loudspeaker, explicitly showing how the electrical and mechanical components are coupled together. The figure also shows the primary components in the loudspeaker that exhibit nonlinear behavior. As shown in FIG. 9, the primary components in the loudspeaker may comprise a cone 901, dust cap 902, spider 903, surround 904, pole plate 905, voice coil 906, pole piece 907, back plate 908, and permanent magnet 909.

Figure 10:
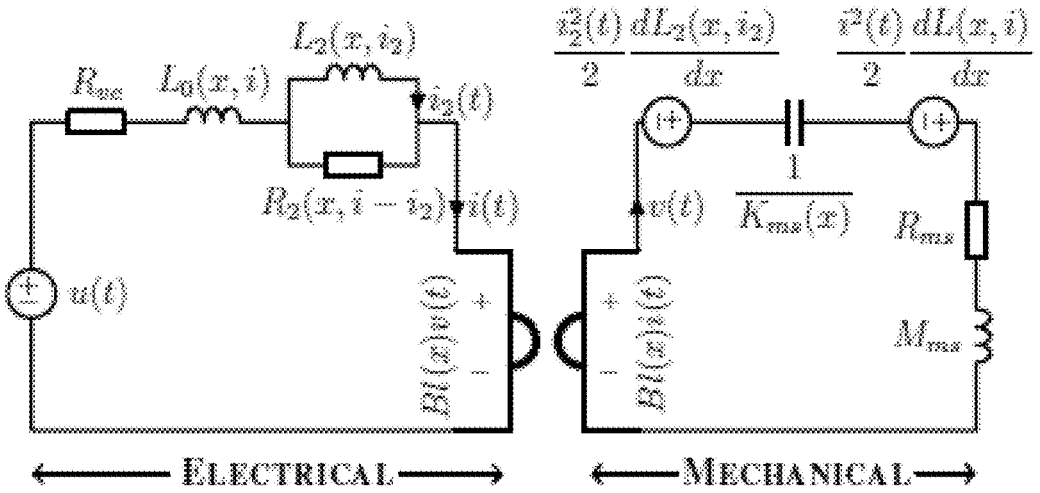
FIG. 10 is an example illustration of a lumped-parameter representation of the loudspeaker of FIG. 9.

FIG. 10 is an example illustration of a lumped-parameter representation of the loudspeaker of FIG. 9. The suspension stiffness $K_{ms}(x)$ arises from the material properties in the surround and the spider of the loudspeaker. The force factor nonlinearity, Bl(x), describes the frequency-independent electro-mechanical coupling in the loudspeaker. This is modeled as a gyrator. The inductance of the voice coil, $L_0(x,i)$, is a function of its displacement x(t) and the current in the voice coil, i(t). To model eddy currents, a parallel combination of an inductance $L_2$ and a resistance $R_2$ is included. These inductances $L_0$ and $L_2$ also induce a reluctance force in the moving components of the loudspeaker. The electrical voice coil windings have a resistance $R_{vc}$. The electrical components are modeled via Kirchhoff's voltage law (KVL). A force equation is written for the mechanical components to include the mechanical load resistance (like friction) $R_{ms}$ that affects the diaphragm and $M_{ms}$, the moving mass of the diaphragm. In this disclosure, we construct an equalizer for the direct-radiator loudspeaker using the model in FIG. 10. Pre-correction of the input audio using this equalizer provides substantial reduction in harmonic distortion at the output of the loudspeaker.

Nonlinear equalizers can be based on truncated Volterra filters. An adaptive truncated Volterra system equalizer can be used for loudspeakers. The mirror filter was obtained by "reflecting" the order of nonlinearities in a lumped parameter model of the loudspeaker. We model the loudspeaker using the electrical and/or mechanical components of the loudspeaker, and then implement an inverse of this model that pre-distorts the input to the loudspeaker model. Our equalizer is obtained by inverting all operations in the loudspeaker model. Unlike prior work, our model and the equalizer includes effects of current-dependent nonlinearities as well as the distortions resulting from eddy currents. Unlike the approaches using truncated Volterra filters, our method is an exact inverse.

Loudspeaker Equalizer

This section describes a simplified loudspeaker model and a formal derivation of an inverse to this loudspeaker model. A DSP 102 comprising a digital nonlinear filter 106 may be referred to in this section as an equalizer.

Loudspeaker Model

Consider the equivalent representation in FIG. 10. Let the voltage u(t) denote the input stimulus to the system. Then, the voice coil current i(t) is related to the parameters of the system through the KVL as, $$u(t) = Bl(x)v(t) = i(v)R_{vc} + \frac{d}{dt}(L_0(x, i)i(t)) + \frac{d}{dt}(L_2(x, i_2)i_2(t)) \tag{1}$$

where, $i_2(t)$ is the current in the para-inductance, Bl(x)v(t) represents the back-emf induced by the force factor and v(t) is the velocity of the loudspeaker diaphragm. Using KVL in the $L_2$–$R_2$ loop, we get $$\frac{d}{dt}(L_2(x, i_2)i_2(t)) = (i(t) - i_2(t))R_2(x, i - i_2) \tag{2}$$

Similarly, for the mechanical components in the lumped parameter circuit, the equation for the force on moving diaphragm is given by, $$M_{ms}\frac{dv(t)}{dt} = \frac{i^2(t)}{2}\frac{dL_0(x, i)}{dx} - K_{ms}(x)\int_0^t v(\tau)d\tau + Bl(x)i(t) - R_{ms}v(t) + \frac{i_2^2(t)}{2}\frac{dL_2(x, i_2)}{dx} \tag{3}$$

Figure 11:
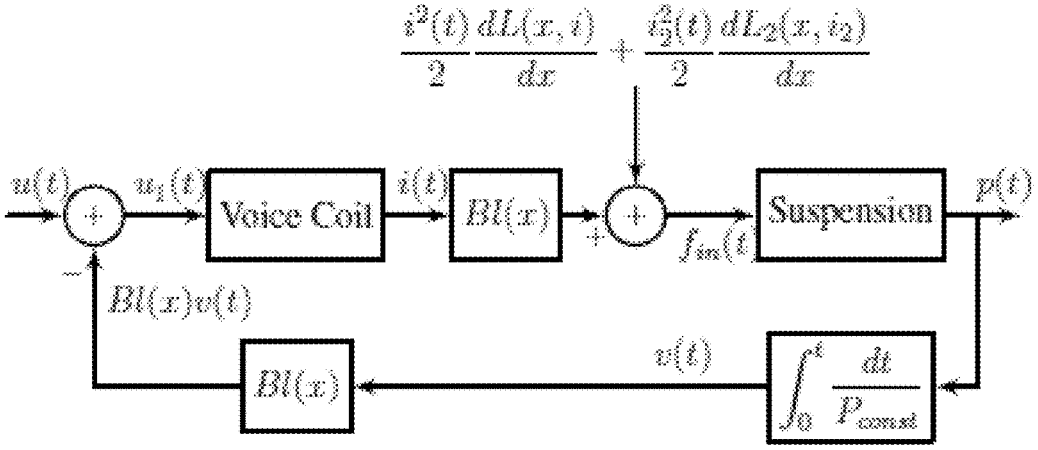
FIG. 11 is an example illustration of a block diagram for the lumped-parameter representation of FIG. 10.

An equivalent block diagram for the loudspeaker can be derived as in FIG. 11. by combining (1), (2) and (3). FIG. 11 is an example illustration of a block diagram for the lumped-parameter representation of FIG. 10. The force signal input $f_{in}(t)$ to the suspension block is given by, $$f_{in}(t) = Bl(x)i(t) + \frac{i^2(t)}{2}\frac{dL_0(x, i)}{dx} + \frac{i_2^2(t)}{2}\frac{dL_2(x, i_2)}{dx} \tag{4}$$

This force moves the diaphragm modulating the air pressure in the region around the loudspeaker. The resulting pressure signal p(t) is modeled as, $$p(t) = P_{const}\frac{dv(t)}{dt} \tag{5}$$

where, $$P_{const} = \frac{\varrho\pi r_{spkr}^2}{2\pi d},$$

d is the distance at which the pressure is measured, $\pi r_{spkr}^2$ represents the effective area of the diaphragm, $r_{spkr}$ represents the radius of the diaphragm and ∂ corresponds to the air density.

Figure 12:
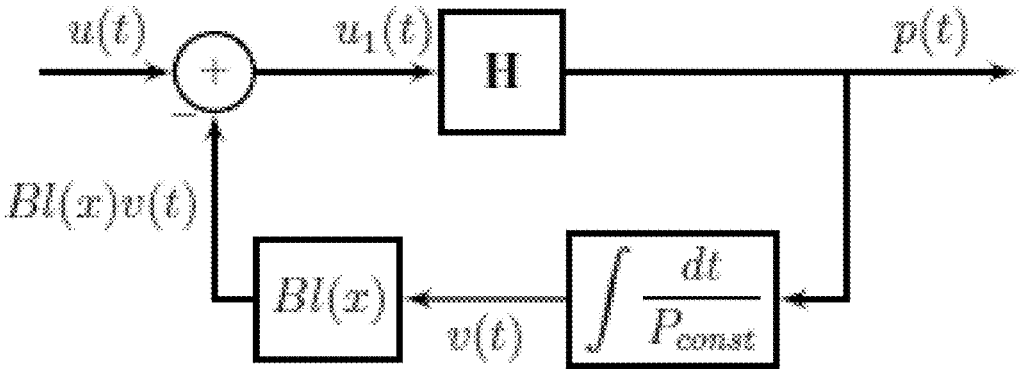
FIG. 12 is an example illustration of simplified model of the block diagram of FIG. 11.

FIG. 11 can be further simplified as shown in FIG. 12 by combining a cascade of the voice coil, the force factor nonlinearity and the suspension system into an equivalent system H. FIG. 12 is an example illustration of simplified model of the block diagram of FIG. 11. The operations in H require the signals x(t) and v(t).

Exact Equalization

Figure 13:
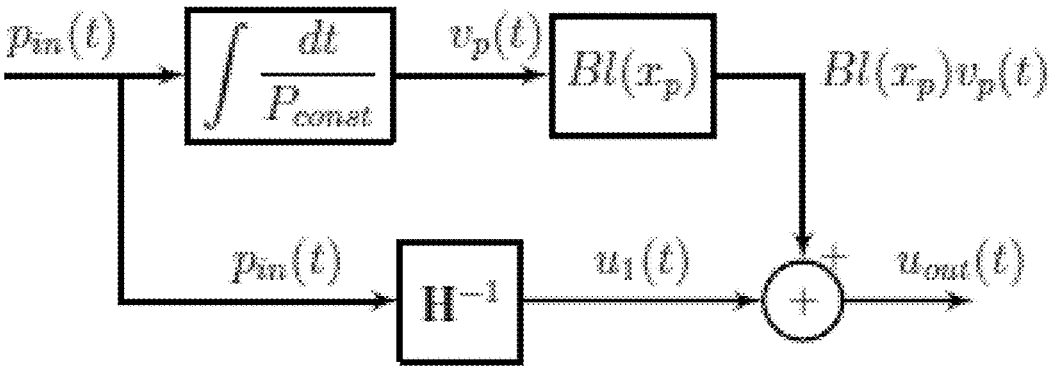
FIG. 13 is an example illustration of loudspeaker pre-inverse based on the simplified model of FIG. 12.

We assume that the input signal $p_{in}(t)$ to the equalizer is the pressure waveform that we wish to reproduce at some distance from the loudspeaker. The diaphragm velocity waveform $v_p(t)$ can be estimated by integrating (5), and the displacement signal $x_p(t)$ can be obtained from the velocity waveform. FIG. 13 is an example illustration of loudspeaker pre-inverse based on the simplified model of FIG. 12. To see this, we start with an expression for $u_{out}(t)$ in FIG. 13.

$$u_{out}(t)=H^{-1}[p_{in}(t)]+Bl(x_p)v_p(t) \tag{6}$$

This output voltage $u_{out}(t)$ from the equalizer is applied to the loudspeaker model to generate an output y(t). Using FIG. 12, this is formulated as, $$y(t)=H[u_{out}(t)-Bl(x_y)v_y(t)] \tag{7}$$

$$x_y(t), v_y(t) \text{ were derived from } y(t). \tag{8}$$

For system $H^{-1}$, a pressure input signal $p_{in}(t)$ is converted to a voltage output $u_1(t)$. System $H^{-1}$ is implemented by reversing the order of operations in H, namely suspension followed by nonlinear scaling, followed by the voice coil, i.e., (3), (2) and (1). Using the estimated velocity waveform, the displacement signal and the acceleration waveform, the current in the voice coil $i_p(t)$ is estimated as, $$i_p(t) = \frac{1}{Bl(x_p)}K_{ms}(x_p)x_p(t) - \frac{i_p^2(t)}{2}\frac{dL_0(x_p, i_p)}{dx}\frac{M_{ms}dv_p(t)}{dt} + R_{ms}v_p(t) - \frac{i_2^2(t)}{2}\frac{dL_2(x_p, i_{2_p})}{dx} \tag{9}$$

where $i_{2_p}(t)$ is the estimated para-inductance current. The nonlinearities in $H^{-1}$ are obtained using signals $i_p(t)$ and $x_p(t)$. Using (Error! Reference source not found.), we may estimate the output voltage signal of system $H^{-1}$, $u_1(t)$, as $$u_1(t) = \frac{d}{dt}(L_0(x_p, i_p)i_p(t)) + \frac{d}{dt}\left(L_2(x_p, i_{2_p})i_{2_p}(t)\right) \pm i_p(t)R_{vc} \tag{10}$$

where the voltage across the para-inductance $L_2$ is computed recursively as, $$\frac{d}{dt}\left(L_2(x_p, i_{2_p})i_{2_p}(t)\right) = \left(i_p(t) - i_{2_p}(t)\right)R_2(x_p, i_p - i_{2_p}) \tag{11}$$

Performance Evaluation

An explicit Runge-Kutta (RK) algorithm of order 4 was used to perform integration operations in the model. An approximate differentiator was constructed as the inverse of this RK-integrator. All signals involved were sampled at 48 kHz. The parameters of the loudspeaker model were obtained through actual characterization of a 3-inch woofer using the Klippel Analyzer at JBL Pro, Northridge, Calif. The model assumed that the nonlinearities $L_0(x,i)$, $L_2(x,i_2)$ and $R_2(x,i-i_2)$ were separable, i.e., $$L_0(x,i)=L_0(x)F_0(i), \tag{12}$$

$$L_2(x,i_2)=L_2(x)F_2(i_2), \tag{13}$$

$$R_2(x,i-i_2)=R_2(x)G_2(i-i_2) \tag{14}$$

The coefficients for $F_0(i)$, $F_2(i_2)$ and $G_2(i-i_2)$ were assumed to be equal. The excursion-dependent terms $L_0(x)$, $L_2(x)$ and $R_2(x)$ were related.

Figure 14:
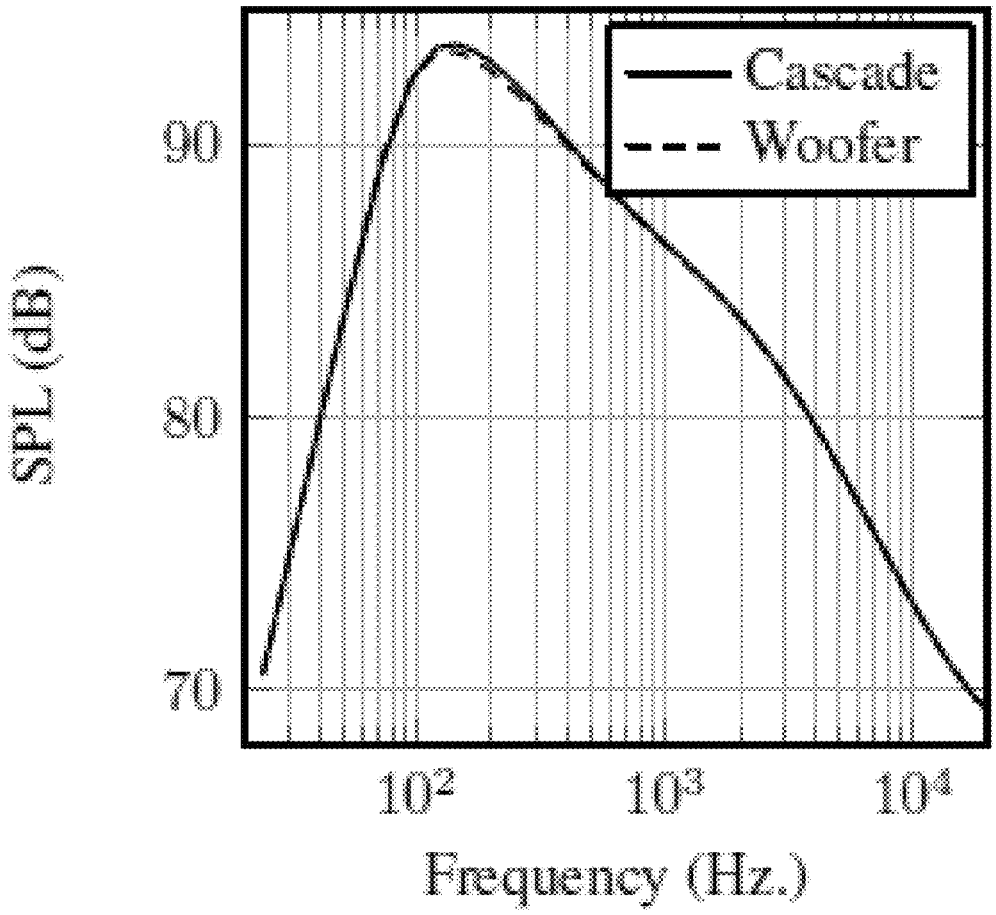
FIG. 14 is an example illustration of comparison of linear responses of a woofer and a cascade comprising of a shaping filter, the equalizer and woofer.
Figure 15:
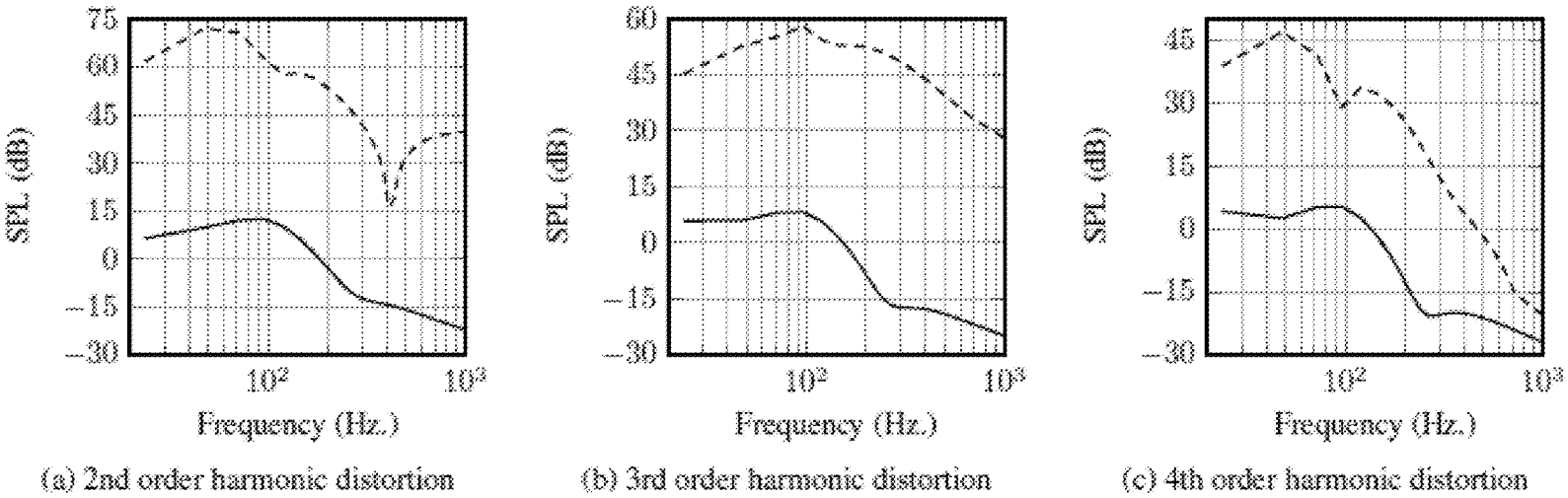
FIG. 15 are example illustrations of harmonic distortion (HD) responses for the equalized woofer and for the non-linear woofer of FIG. 14.
Figure 16:
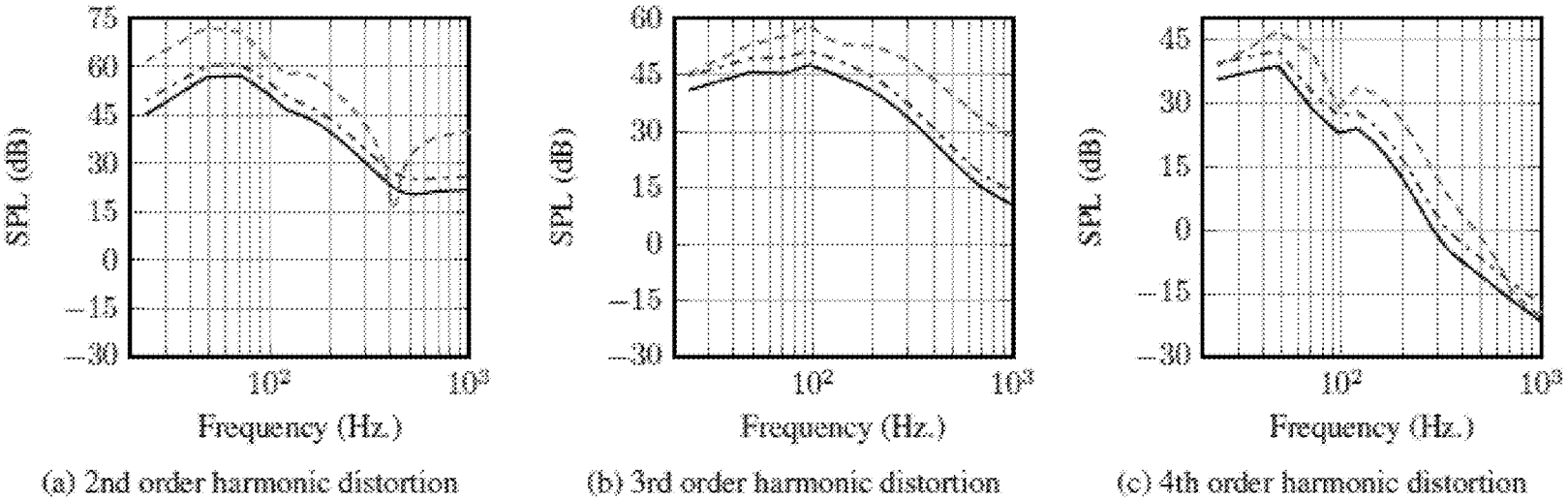
FIG. 16 are example illustrations of harmonic distortion (HD) for the equalized system when the nonlinear parameters in the woofer are perturbed using a random error with $\alpha=0.1$.

FIGS. 14-16 are provided for illustrating performance evaluations of the digital nonlinear filter. FIG. 14 is an example illustration of comparison of linear responses of a woofer and a cascade comprising of a shaping filter, the equalizer and woofer. The shaping filter used had a linear response that was similar to that of the loudspeaker. Minor differences between the linear response of the woofer and the measured linear response of the equalized loudspeaker were observed in FIG. 14.

Second, third and fourth order harmonic distortions were measured for the forward loudspeaker model and the cascade of the shaping filter, equalizer and the loudspeaker model using 5.65V RMS (root-mean squared) sinusoidal waveforms of frequencies in the range 24 Hz. and 20 kHz. The sound pressure level (SPL) for the n-th harmonic of a sine waveform with frequency $\omega_0$, was computed as the ratio of the power at frequency $n\omega_0$ to the reference sound pressure level (20 μPa.).

FIG. 15 displays the measured harmonic distortions for the woofer (dashed) and the equalized woofer (solid). A substantial reduction in the harmonic distortion was observed because of equalization using our equalizer. Ideally, the distortions associated with the equalized woofer should be zero. These non-ideal results in the figure were attributed to computation and measurement errors.

In order to test the system for robustness against inaccuracies in the loudspeaker model, we introduced a mismatch between equalizer and loudspeaker model parameters. This could also be used to simulate aging in the loudspeaker as well as errors in estimation of the parameters. Specifically, the parameters of the loudspeaker model were perturbed by multiplicative noise in the form $$w_p=w(1+\kappa) \tag{15}$$

where w is any coefficient of the original model and K is a uniformly distributed random variable in the range $[-\alpha, \alpha]$. The equalizer used the original parameters w while the woofer used the perturbed parameters $w_p$.

FIG. 16 are example illustrations of harmonic distortion (HD) for the equalized system when the nonlinear parameters in the woofer are perturbed using a random error with $\alpha=0.1$. FIG. 16 displays the harmonic distortions for orders two, three and four for this case of model mismatch with $\alpha=0.1$. Black bold lines: mean HD response over 100 independent estimates. Blue dash-dot lines: mean HD response+σ(standard deviation) of the HD responses. Red dashed lines: Response of the nonlinear woofer. We can see that even with this level of mismatch, the system on average is able to reduce the harmonic distortion in the output of the equalizer by 10-15 dB at most frequencies. Accurate modeling of the loudspeaker is allows for additional mitigation of the distortions.

Other Models of a Loudspeaker

In some embodiments, the digital nonlinear filter 106 is based on an inverse of an electro-mechanical model of the loudspeaker, as discussed above. However, in other embodiments, the digital nonlinear filter 106 is based on an inverse of another type of nonlinear model of the loudspeaker. For example, the model may comprise a Volterra series based model, a Hammerstein model, or a nonlinear state space model of the loudspeaker. In the below discussion of these models, let p(t) denote pressure signal output of the loudspeaker and u(t) denote the input voltage signal of the loudspeaker.

Volterra series based models are black-box models that approximate the response of the loudspeaker as the summation of the responses of direct current (DC), linear, and different order nonlinear subsystems, as characterized by the below equation:

$$p(\tau) = h_0 + \sum_{m=1}^{M} h_1(m)u(t-m) + \sum_{m_1=1}^{M}\sum_{m_2=1}^{N} h_2(m_1, m_2)u(t-m_1)u(t-m_2) + \ldots \tag{16}$$

In equation (16), $h_0$ is the DC component, $h_1(t)$ is the estimate of the linear response of the loudspeaker, $h_2(t_1,t_2)$ is the two dimensional impulse response of the second order nonlinearities of the loudspeaker and so forth.

A Hammerstein model is a black-box model that approximates the response of the loudspeaker with a parallel combination of static nonlinearities cascaded with dynamic linear systems, as characterized by the below equation:

$$p(\tau) = g_0 + \sum_{m=1}^{M} g_1(m)u(t-m) + \sum_{m=1}^{M} g_2(m)u^2(t-m) + \sum_{m=1}^{M} g_3(m)u^2(t-m) + \ldots \tag{17}$$

In equation (17), $g_0$ is the DC component, $g_1$ (t) is the linear (frequency) response of the loudspeaker, and $g_2(t)$ is the one dimensional estimate of the impulse response of the second order nonlinearities of the loudspeaker.

Nonlinear state space models comprise a broader class of the models where the internal state of the loudspeaker is estimated, which is used to compute the output of the loudspeaker, as characterized by the below equations:

$$x(t+1)=f(x(t),u(t)) \tag{18}$$

$$p(t)=h(x(t),u(t)) \tag{19}$$

In equations (18) and (19), f(.) and h(.) are nonlinear functions and x(t) is an estimate of the state of the loudspeaker. In the case of electromechanical models, the state x(t) can comprise the voice coil current, para-inductance current, excursion, and velocity of the cone.

Technique for Producing a Nonlinear Filter for Distortion Correction

Figure 17:
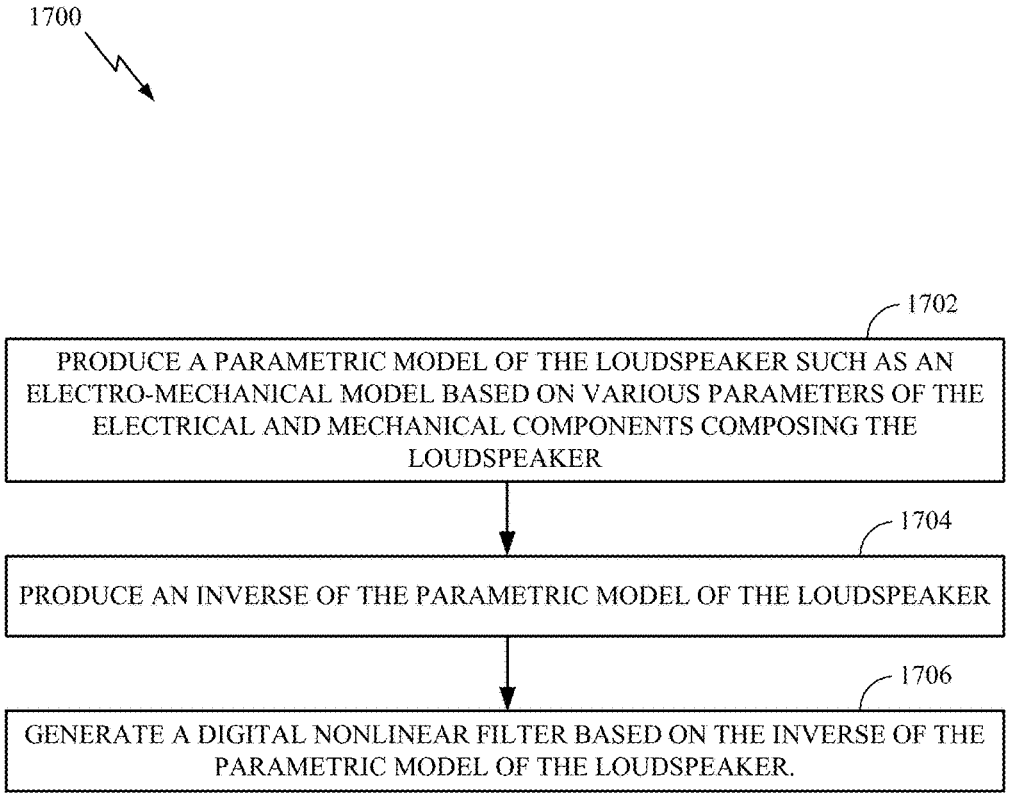
FIG. 17 is a flow diagram of operations for creating a digital nonlinear filter to process an audio signal, in accordance with aspects of the present disclosure.

FIG. 17 is a flow diagram of operations 1700 for creating a digital nonlinear filter to process an audio signal, in accordance with aspects of the present disclosure. The operations 1700 may be performed, for example, by at least one processor (e.g., a computer processing system).

The operations 1700 begin, at 1702, by producing a parametric model of the loudspeaker based on a plurality of parameters of the loudspeaker. In some embodiments, the parametric model may comprise an electro-mechanical model of the loudspeaker 112 that is based on various parameters of the electrical and mechanical components composing the loudspeaker 112. The processor then produces, at 1704, an inverse of the parametric model of the loudspeaker. At 1706, the processor may generate a digital nonlinear filter 106 based on the inverse of the parametric model of the loudspeaker.

Processing Audio Data Via Digital Linear and Nonlinear Filters

The digital linear filter 104 (providing audio extension) and digital nonlinear filter 106 (providing reduction of nonlinear distortion) can be applied to the digital audio signal separately and independently, or in combination to provide both audio extension and reduction of nonlinear distortion of the loudspeaker.

Figure 18:
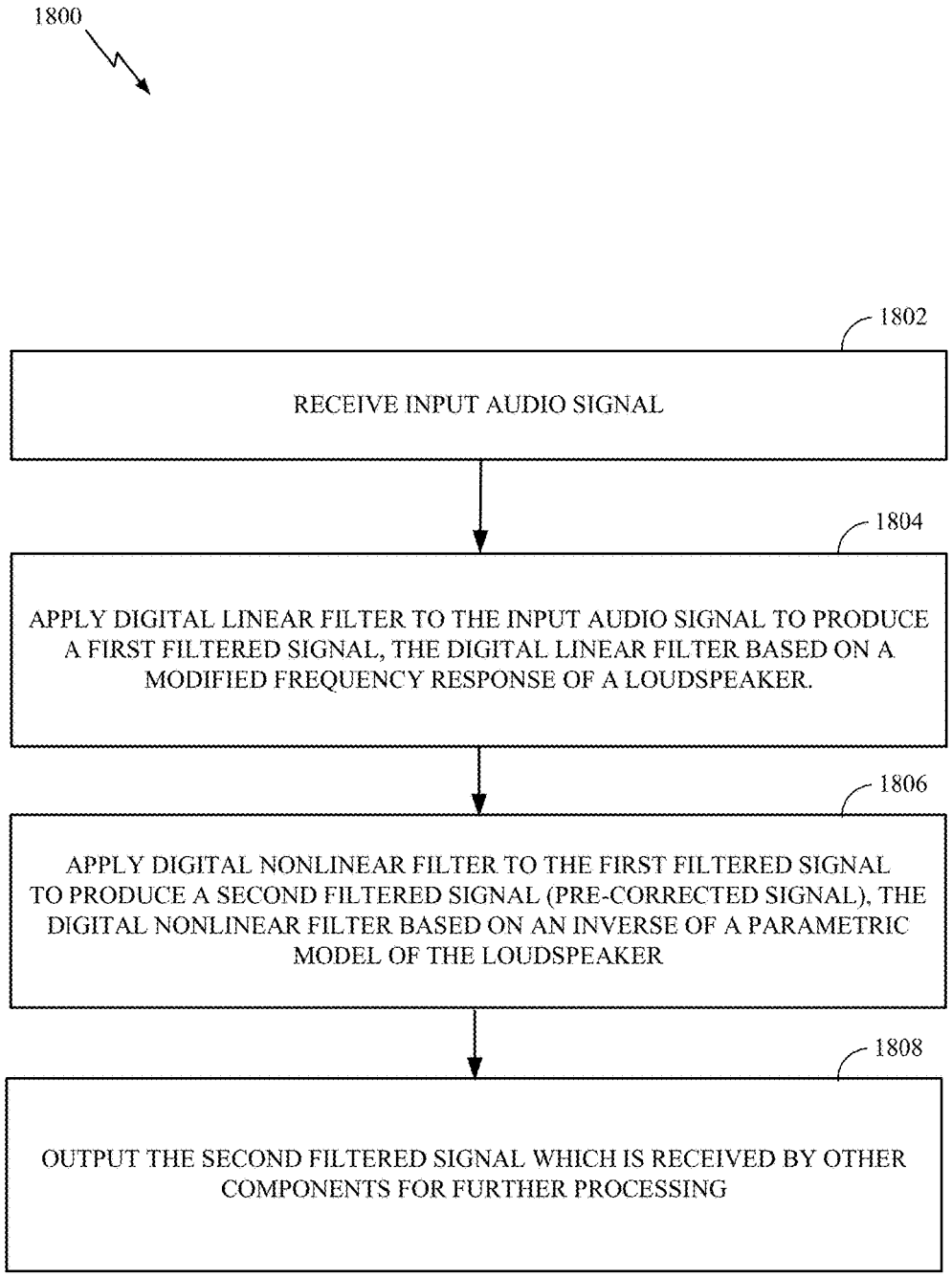
FIG. 18 is a flow diagram of operations for processing a digital audio signal via a digital linear filter and a digital nonlinear filter, in accordance with certain aspects of the present disclosure.

FIG. 18 is a flow diagram of operations 1800 for processing a digital audio signal via a digital linear filter 104 and a digital nonlinear filter 106, in accordance with certain aspects of the present disclosure. At least some of the operations 1800 may be performed, for example, by a processor, such as the DSP 102 comprising the digital linear filter 104 and the digital nonlinear filter 106. The DSP 102 may comprise computer hardware (such as a processor) that executes software stored on a computer-readable medium to perform the operations 1800.

The operations 1800 may begin, at 1802, when the DSP 102 receives an input digital audio signal 114. The DSP 102 applies, at 1804, a digital linear filter 104 (e.g., modified shaping filter 104) to the digital audio signal 114 to produce a first filtered signal 116. The digital linear filter 104 is based on a modified frequency response created by modifying at least a portion of an original frequency response representative of a loudspeaker. The first filtered signal 116 provides audio extension of the original frequency response representative of a loudspeaker. At 1806, the DSP 102 applies a digital nonlinear filter 106 (e.g., nonlinear correction filter 106) to the first filtered signal 116 to generate a second filtered signal (pre-corrected signal 118). The digital nonlinear filter 106 is based on an inverse of an electro-mechanical model of the loudspeaker and provides pre-correction/pre-distortion of the audio signal to cancel out or reduce the nonlinear distortions present in the loudspeaker. At 1808, the DSP 102 outputs the second filtered signal, which is received by other components for further processing (e.g., received by the DAC to convert the pre-corrected signal 118 to an analog signal which is amplified by an amplifier to drive the loudspeaker). In other embodiments, the DSP 102 may be configured to first apply the digital nonlinear filter 106 to filter the audio signal 114, and then apply the digital linear filter 104 to filter the filtered audio signal from the digital nonlinear filter 106.

By applying both the digital linear filter 104 (e.g., modified shaping filter 104) and the digital nonlinear filter 106 (e.g., nonlinear correction filter 106) to an input audio signal, the combination of filters 104 and 106 may provide audio extension of the original frequency response of the loudspeaker and pre-correction of the audio signal to cancel out or reduce the nonlinear distortions present in the loudspeaker, thus providing higher fidelity audio.

Various Embodiments

The digital linear filter (e.g., modified shaping filter 104) and the digital nonlinear filter (e.g., nonlinear correction filter 106) may be applied to an audio signal 114 by the DSP 102 as described with reference to FIG. 1. For example, the digital filters 104 and 106 (e.g., linear and nonlinear) may be generated using software executed on a processing system. Firmware or software for the digital filters may be stored in memory that is either integrated in, or external to, the DSP 102. The DSP will implement the filters on a digital audio signal (input to or being processed by the DSP) based on the firmware or software stored in memory.

The various operations described above may be performed by any suitable means capable of performing the corresponding functions. The means may include various hardware and/or software component(s) and/or module(s), including, but not limited to a circuit, an application specific integrated circuit (ASIC), or processor.

For example, means for applying (a filter) and means for processing may comprise a processor, such as the DSP 102 of FIG. 1. Means for converting may comprise a DAC, such as the DAC 108 of FIG. 1. Means for amplifying may comprise an amplifier, such as the amplifier 110 of FIG. 1. Means for extending, means for processing, means for modifying, means for adjusting, and means for generating may comprise a processor, such as a central processing unit (CPU) of a computer. This computer may be operated by a developer of the linear and nonlinear filters described herein.

Aspects of the present disclosure may take the form of an entirely hardware embodiment, an entirely software embodiment (including firmware, resident software, micro-code, etc.), or an embodiment combining software and hardware aspects that may all generally be referred to herein as a "circuit," "module," or "system." The present disclosure may be a system, a method, and/or a computer program product. The computer program product may include a non-transitory computer-readable storage medium (or media) having computer-readable program instructions thereon for causing a processor to carry out aspects of the present disclosure.

The computer-readable storage medium can be a tangible device that can retain and store instructions for use by an instruction execution device. The computer-readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer-readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer-readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer-readable program instructions described herein can be downloaded to respective computing/processing devices from a computer-readable storage medium or to an external computer or external storage device via a network, for example, the Internet, a local area network (LAN), a wide area network (WAN) and/or a wireless network. The network may comprise copper transmission cables, optical transmission fibers, wireless transmission, routers, firewalls, switches, gateway computers and/or edge servers. A network adapter card or network interface in each computing/processing device receives computer-readable program instructions from the network and forwards the computer-readable program instructions for storage in a computer-readable storage medium within the respective computing/processing device.

Computer-readable program instructions for carrying out operations of the present disclosure may be assembler instructions, instruction-set-architecture (ISA) instructions, machine instructions, machine-dependent instructions, microcode, firmware instructions, state-setting data, or either source code or object code written in any combination of one or more programming languages, including an object oriented programming language such as Smalltalk, C++, or the like, and conventional procedural programming languages, such as the "C" programming language or similar programming languages. The computer-readable program instructions may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a LAN or a WAN, or the connection may be made to an external computer (for example, through the Internet using an Internet Service Provider (ISP)). In some embodiments, electronic circuitry including, for example, programmable logic circuitry, field-programmable gate arrays (FPGAs), or programmable logic arrays (PLAs) may execute the computer-readable program instructions by utilizing state information of the computer-readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer-readable program instructions.

These computer-readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer-readable program instructions may also be stored in a computer-readable storage medium that can direct a computer, a programmable data processing apparatus, and/or other devices to function in a particular manner, such that the computer-readable storage medium having instructions stored therein comprises an article of manufacture including instructions which implement aspects of the function/act specified in the flowchart and/or block diagram block or blocks.

The computer-readable program instructions may also be loaded onto a computer, other programmable data processing apparatus, or other device to cause a series of operational steps to be performed on the computer, other programmable apparatus or other device to produce a computer-implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It must be noted that, as used in this specification and the appended claims, the singular forms "a," "an," and "the" include plural referents unless the context clearly dictates otherwise. Thus, for example, reference to "a wave" includes one or more of such elements, reference to "rows" includes reference to one or more of such features, and reference to "exposing" includes one or more of such steps.

In describing and claiming the present disclosure, the following terminology will be used in accordance with the definitions set forth below.

As used herein, "substantial" when used in reference to a quantity or amount of a material, or a specific characteristic thereof, refers to an amount that is sufficient to provide an effect that the material or characteristic was intended to provide. Therefore, "substantially free" when used in reference to a quantity or amount of a material, or a specific characteristic thereof, refers to the absence of the material or characteristic, or to the presence of the material or characteristic in an amount that is insufficient to impart a measurable effect, normally imparted by such material or characteristic.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 0.6 mm to about 0.3 mm" should be interpreted to include not only the explicitly recited values of about 0.6 mm and about 0.3 mm, but also include individual values and sub-ranges within the indicated range. Thus, included in this numerical range are individual values such as 0.4 mm and 0.5, and sub-ranges such as from 0.5-0.4 mm, from 0.4-0.35, etc. This same principle applies to ranges reciting only one numerical value. Furthermore, such an interpretation should apply regardless of the breadth of the range or the characteristics being described.

As used herein, the term "about" means that dimensions, sizes, formulations, parameters, shapes and other quantities and characteristics are not and need not be exact, but may be approximated and/or larger or smaller, as desired, reflecting tolerances, conversion factors, rounding off, measurement error and the like and other factors known to those of skill in the art. Further, unless otherwise stated, the term "about" shall expressly include "exactly," consistent with the discussion above regarding ranges and numerical data.

In the present disclosure, the term "preferably" or "preferred" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the disclosure should be determined solely by the appended claims and their legal equivalents, rather than by the descriptions and examples given herein.

Reference throughout this specification to "an example" or "exemplary" means that a particular feature, structure, or characteristic described in connection with the example is included in at least one embodiment of the present invention. Thus, appearances of the phrases "in an example" or the word "exemplary" in various places throughout this specification are not necessarily all referring to the same embodiment.

While the foregoing is directed to embodiments of the present disclosure, other and further embodiments of the disclosure may be devised without departing from the basic scope thereof, and the scope thereof is determined by the claims that follow.

What is claimed is:

1. A method for processing an audio signal, comprising:

applying a linear filter to the audio signal, the linear filter based on a modified frequency response of a loudspeaker that is produced by modifying at least a portion of an original frequency response of the loudspeaker;

applying a nonlinear filter to the audio signal, the nonlinear filter based on an inverse of a model of the loudspeaker, wherein the model comprises a Volterra series based model that approximates a response of the loudspeaker as a summation of responses of direct current (DC), linear, and different order nonlinear subsystems; and applying an updated nonlinear filter to the audio signal, the updated nonlinear filter based on an inverse of a modified model of the loudspeaker.

2. The method of claim 1, wherein the model includes at least one parameter associated with at least one of an electrical component and a mechanical component of the loudspeaker.

3. The method of claim 2, wherein the at least one parameter comprises at least one of an excursion dependent nonlinearity and a current-dependent nonlinearity.

4. The method of claim 1, wherein the linear filter comprises a modified shaping filter.

5. The method of claim 1, wherein the original frequency response is modified by extending a low frequency response to provide an increased sound pressure level at low audio frequencies.

6. The method of claim 5, wherein extending the low frequency response also changes a resonant frequency of the original frequency response.

7. The method of claim 1, wherein the original frequency response is modified by extending all frequencies in a selected bandwidth of the original frequency response to provide an increased sound pressure level within the selected bandwidth.

8. The method of claim 1, further comprising modifying at least one age parameter of the model of the loudspeaker based on a predetermined function that considers at least one of an operating time for the loudspeaker and a total amount of power transferred to the loudspeaker.

9. The method of claim 8, further comprising measuring, via a sensor, at least one of the operating time for the loudspeaker and the total amount of power transferred to the loudspeaker.

10. The method of claim 8, further comprising tracking, via a digital signal processor, at least one of the operating time for the loudspeaker and the total amount of power transferred to the loudspeaker.

11. The method of claim 10, wherein the digital signal processor modifies the at least one age parameter of the model of the loudspeaker via firmware or software stored in a memory of the digital signal processor.

12. A digital signal processor for processing an audio signal, comprising:

a linear filter for processing the audio signal, the linear filter based on a modified frequency response of a loudspeaker that is produced by modifying at least a portion of an original frequency response of the loudspeaker; and a nonlinear filter for processing the audio signal, the nonlinear filter based on an inverse of a model of the loudspeaker, wherein the model comprises a Hammerstein model that approximates a response of the loudspeaker with a parallel combination of static nonlinearities cascaded with dynamic linear systems, wherein an updated nonlinear filter is applied to the audio signal, the updated nonlinear filter based on an inverse of a modified model of the loudspeaker.

13. The digital signal processor of claim 12, wherein the model includes at least one parameter associated with at least one of an electrical component and a mechanical component of the loudspeaker.

14. The digital signal processor of claim 13, wherein the at least one parameter comprises nonlinear distortions of the loudspeaker that depend on geometric construction and materials used in a voice coil, a diaphragm, or an enclosure of the loudspeaker.

15. The digital signal processor of claim 12, wherein the linear filter comprises a modified shaping filter.

16. The digital signal processor of claim 12, wherein the original frequency response is modified by extending all frequencies in a selected bandwidth of the original frequency response to provide an increased sound pressure level in the selected bandwidth.

17. The digital signal processor of claim 16, wherein all frequencies in the selected bandwidth are uniformly extended.

18. The digital signal processor of claim 16, wherein different frequencies in the selected bandwidth are differently extended.

19. The digital signal processor of claim 12, wherein at least one age parameter of the model of the loudspeaker is modified based on a predetermined function that considers at least one of an operating time for the loudspeaker and a total amount of power transferred to the loudspeaker.

20. A non-transitory computer readable medium storing instructions that, when executed by a processor, cause the processor to process an audio signal, by performing the steps of: applying a nonlinear filter to the audio signal, the nonlinear filter based on an inverse of an electro-mechanical model of a loudspeaker that includes a plurality of parameters associated with at least one of an electrical component and a mechanical component of the loudspeaker, wherein the plurality of parameters comprises excursion dependent nonlinearities or current-dependent nonlinearities, wherein the model comprises a nonlinear state space model, whereby an internal state of the loudspeaker is estimated, which is used to compute an output of the loudspeaker; and applying an updated nonlinear filter to the audio signal, the updated nonlinear filter based on an inverse of a modified model of the loudspeaker.

21. The non-transitory computer readable medium of claim 20, wherein the plurality of parameters comprises at least one eddy current of the loudspeaker.

22. The non-transitory computer readable medium of claim 20, further comprising modifying at least one age parameter of the model of the loudspeaker based on a predetermined function that considers at least one of an operating time for the loudspeaker and a total amount of power transferred to the loudspeaker.

23. A method for processing an audio signal, comprising:

applying a linear filter to the audio signal, the linear filter based on a modified frequency response of a loudspeaker that is produced by modifying at least a portion of an original frequency response of the loudspeaker, wherein the original frequency response is modified by extending a low frequency response to provide an increased sound pressure level at low audio frequencies; and applying a nonlinear filter to the audio signal, the nonlinear filter based on an inverse of a model of the loudspeaker.

24. The method of claim 23, wherein extending the low frequency response also changes a resonant frequency of the original frequency response.

25. A method for processing an audio signal, comprising:

applying a linear filter to the audio signal, the linear filter based on a modified frequency response of a loudspeaker that is produced by modifying at least a portion of an original frequency response of the loudspeaker, wherein the original frequency response is modified by extending all frequencies in a selected bandwidth of the original frequency response to provide an increased sound pressure level within the selected bandwidth; and applying a nonlinear filter to the audio signal, the nonlinear filter based on an inverse of a model of the loudspeaker.

* * * * *